US011220785B2

(12) United States Patent
Aronsson et al.

(10) Patent No.: US 11,220,785 B2
(45) Date of Patent: Jan. 11, 2022

(54) TISSUE PAPER MAKING MACHINE AND A METHOD OF OPERATING A TISSUE PAPER MAKING MACHINE

(71) Applicant: VALMET AKTIEBOLAG, Sundsvall (SE)

(72) Inventors: Joakim Aronsson, Kil (SE); Karl-Johan Tolfsson, Forshaga (SE); Jan Paulsson, Kil (SE); Göran Ekström, Vaese (SE)

(73) Assignee: VALMET AKTIEBOLAG, Sundsvall (SE)

( * ) Notice: Subject to any disclaimer, the term of this patent is extended or adjusted under 35 U.S.C. 154(b) by 0 days.

(21) Appl. No.: 17/275,433

(22) PCT Filed: Sep. 3, 2019

(86) PCT No.: PCT/SE2019/050822
§ 371 (c)(1),
(2) Date: Mar. 11, 2021

(87) PCT Pub. No.: WO2020/076204
PCT Pub. Date: Apr. 16, 2020

(65) Prior Publication Data

US 2021/0246613 A1 Aug. 12, 2021

(30) Foreign Application Priority Data

Oct. 12, 2018 (SE) ..... 1851245-9

(51) Int. Cl.
*D21F 3/02* (2006.01)
*D21F 9/00* (2006.01)
(Continued)

(52) U.S. Cl.
CPC ..... *D21F 3/0218* (2013.01); *D21F 3/0227* (2013.01); *D21F 3/0281* (2013.01);
(Continued)

(58) Field of Classification Search
CPC ..... D21F 3/0218; D21F 3/045; D21F 3/0281; D21F 9/003; D21F 5/181; D21F 11/006; D21F 11/14; D21H 27/002
(Continued)

(56) References Cited

U.S. PATENT DOCUMENTS 4,917,768 A 4/1990 Ilmarinen
5,084,137 A 1/1992 Ilmarinen et al.
(Continued)

FOREIGN PATENT DOCUMENTS

EP 0719360 B1 2/1998
EP 0926296 B1 7/2004
(Continued)

OTHER PUBLICATIONS

International Searching Authority, International Search Report and Written Opinion received for International Application No. PCT/SE2019/050822, dated Sep. 24, 2019, 9 pages, Swedish Patent and Registration Office, Sweden.
(Continued)

*Primary Examiner* — Eric Hug
(74) *Attorney, Agent, or Firm* — Alston & Bird LLP

(57) ABSTRACT

A tissue machine (1) has a Yankee (3) and a shoe roll (4) that forms a nip with the Yankee (3). The nip has a maximum extension from an entry point (7) to an exit point (8). A flexible belt (9) forms an outer circumference of the roll (4). A fabric (10) carries a fibrous web (W) to the nip and passes through the nip with the web. The fabric (10) reaches the circumference of the roll (4) at a first contact point (11) and wraps the roll (4) from the first contact point to the nip. A mechanical support (12) inside the belt (9) supports the belt (9) between the first contact point (11) and the nip. The
(Continued)

fabric (10) wraps the roll (4) from the first contact point (11) by more than 80°. The invention also relates to a method of operating the machine.

19 Claims, 11 Drawing Sheets

(51) Int. Cl.

| | |
|---|---|
| ***D21F 5/18*** | (2006.01) |
| ***D21F 11/14*** | (2006.01) |
| ***D21H 27/00*** | (2006.01) |
| ***D21F 3/04*** | (2006.01) |
| ***D21F 7/08*** | (2006.01) |
| *D21F 9/02* | (2006.01) |

(52) U.S. Cl.
CPC ..... *D21F 3/045* (2013.01); *D21F 5/181* (2013.01); *D21F 7/08* (2013.01); *D21F 9/003* (2013.01); *D21F 11/14* (2013.01); *D21H 27/002* (2013.01); *D21F 9/02* (2013.01)

(58) Field of Classification Search
USPC ..... 162/358.3, 358.5
See application file for complete search history.

(56) References Cited

U.S. PATENT DOCUMENTS

| | | | | |
|---|---|---|---|---|
| 5,098,523 | A | 3/1992 | Ilmarinen et al. | |
| 5,223,100 | A | 6/1993 | Schiel et al. | |
| 5,393,384 | A | 2/1995 | Steiner et al. | |
| 5,416,979 | A | 5/1995 | Joiner | |
| 5,662,777 | A | 9/1997 | Schiel et al. | |
| 5,700,357 | A | 12/1997 | Didier | |
| 5,972,813 | A | 10/1999 | Polat et al. | |
| 6,004,429 | A * | 12/1999 | Schiel | D21F 3/0218 162/111 |
| 6,083,349 | A * | 7/2000 | Schiel | D21F 3/0218 162/206 |
| 6,083,352 | A | 7/2000 | Snellman et al. | |
| 6,235,160 | B1 * | 5/2001 | Tietz | D21F 3/0281 162/281 |
| 6,355,143 | B1 | 3/2002 | Kilian et al. | |
| 6,821,391 | B2 | 11/2004 | Scherb et al. | |
| 6,998,022 | B2 | 2/2006 | Hultcrantz | |
| 7,008,506 | B2 | 3/2006 | Scherb et al. | |
| 7,387,710 | B2 | 6/2008 | Bengtsson | |
| 7,527,708 | B2 | 5/2009 | Gustavsson | |
| 7,914,649 | B2 | 3/2011 | Ostendorf et al. | |
| 8,366,878 | B2 | 2/2013 | Klerelid et al. | |
| 8,438,752 | B2 | 5/2013 | Mennucci et al. | |
| 8,840,857 | B1 | 9/2014 | Guo et al. | |
| 9,181,655 | B2 * | 11/2015 | Gustavsson | D21F 3/0281 |
| 9,885,153 | B2 | 2/2018 | Meitner et al. | |
| 10,472,768 | B1 * | 11/2019 | Poikolainen | D21F 9/003 |
| 10,808,359 | B2 * | 10/2020 | Tolfsson | D21F 3/0281 |
| 2015/0233054 | A1 | 8/2015 | Gustavsson | |

FOREIGN PATENT DOCUMENTS

| | | | | |
|---|---|---|---|---|
| EP | 1873305 | A2 | 1/2008 | |
| EP | 2085513 | B1 | 9/2011 | |
| EP | 2910679 | * | 8/2015 | D21F 11/006 |
| EP | 2808442 | B1 | 11/2015 | |
| WO | WO 2010/033072 | A1 | 3/2010 | |
| WO | WO 2011/030363 | A1 | 3/2011 | |
| WO | WO 2016/169915 | A1 | 10/2016 | |
| WO | WO 2018/097777 | A1 | 5/2018 | |

OTHER PUBLICATIONS

Swedish Patent and Registration Office, Swedish Search Report received for Application No. 1851245-9, dated Apr. 16, 2019, 3 pages, Sweden.

* cited by examiner

TISSUE PAPER MAKING MACHINE AND A METHOD OF OPERATING A TISSUE PAPER MAKING MACHINE

CROSS REFERENCE TO RELATED APPLICATIONS

This application is a National Stage Application, filed under 35 U.S.C. 371, of International Application No. PCT/SE2019/050822, filed Sep. 3, 2019, which international application claims priority to and the benefit of Swedish (SE) Application No. 1851245-9, filed Oct. 12, 2018; the contents of both of which as are hereby incorporated by reference in their entireties.

BACKGROUND

Related Field

The present invention relates to a tissue paper making machine and to a method of operating a tissue paper making machine.

Description of Related Art

In tissue paper making machines, a fibrous web formed in the forming section is typically carried by a carrier fabric to a Yankee drying cylinder where the fibrous web is transferred to the surface of the Yankee drying cylinder. The transfer to the Yankee drying cylinder is typically made in a transfer nip which often also serves as a dewatering nip. An example of such a tissue paper making machine is disclosed in U.S. Pat. No. 6,998,022. It has also been proposed that a shoe roll be used in the transfer nip such that the web is transferred to the Yankee drying cylinder in a nip between a shoe roll and the Yankee drying cylinder. An example of such a tissue paper making machine is disclosed in, for example, U.S. Pat. No. 5,393,384. With reference to FIG. 7 of U.S. Pat. No. 5,393,384, an embodiment is disclosed in which a water-impermeable belt 2 carries a paper web to a nip formed between a "shoe press" and a "tissue drying cylinder" 20. Another example of such a machine is disclosed in European patent No. 926 296 which discloses how a fibrous web is transported by a felt 5 to a nip between a shoe press unit 2 and a tissue drying cylinder 3. The nip between the shoe press unit and the tissue drying cylinder is preceded by a suction roll 6 that is said to remove water from the felt and possibly also from the fibrous web. It is further stated that, thanks to the action of the suction roll, the ability of the felt to receive water is increased significantly such that it can receive water in the press nip. It is stated that this has the effect that the dewatering becomes so much intense that only one press nip is sufficient.

While the use of a suction roll prior to the nip against the Yankee drying cylinder may increase dewatering to such an extent that only one dewatering press nip is sufficient, the use of a suction roll also has some disadvantages. A suction roll requires energy and increases the cost of operating the machine. Moreover, a suction roll contributes to generating noise.

Another example of a tissue paper making machine with a shoe press nip against a tissue drying cylinder is disclosed in U.S. Pat. No. 6,004,429. That patent discloses a machine in which a press roll 28 that is embodied as a shoe press roll is arranged to form a main press 30 with a drying cylinder 60. The main press 30 is preceded by a pre-press formed by a grooved bottom roll 38 and a shoe press roll 40 with a press shoe and a smooth, impermeable flexible press jacket. A felt 12 travels via the pre-press to the main press 30. It is stated that, with this arrangement, a suction roll becomes unnecessary. In the FIG. 1 and FIG. 4 of U.S. Pat. No. 6,004,429, the felt that passes through the pre-press is shown as going directly to the main press 30 without first passing a suction roll. It is stated that the felt 12 winds around the shoe press roll 28 of the main press 30 by more than 45°. It is furthermore stated that the press jacket should be supported from the inside. To provide support from the inside of the press jacket, U.S. Pat. No. 6,004,429 suggests that the press jacket be supported from the inside by small support rolls 86 and FIG. 4 of the '429 patent shows how support rolls 86 are placed on the inside of the press jacket 84. It is stated that it is advantageous if the angular distance between the support rolls in the circumferential direction lies in the range from approximately 7.5 degrees to approximately 15 degrees.

It is an object of the present invention to provide a tissue paper making machine which uses a shoe roll to form a transfer nip against a Yankee drying cylinder and which can operate effectively and achieve a reliable web transfer to the Yankee drying cylinder.

BRIEF SUMMARY

The invention relates to a tissue paper making machine. The inventive tissue paper making machine comprises a forming section and a Yankee drying cylinder A shoe roll is arranged to form a nip with the Yankee drying cylinder. The nip between the shoe roll and the Yankee drying cylinder may be a dewatering nip but it may also be arranged to function as substantially only a pure transfer nip in which a fibrous web is transferred to the outer surface of the Yankee drying cylinder. The shoe roll has a shoe arranged to act against the Yankee drying cylinder in the nip formed between the shoe roll and the Yankee drying cylinder. The shoe roll further comprises a flexible tubular belt that forms a loop around the shoe and which also forms an outer circumference of the shoe roll. The nip between the shoe roll and the Yankee drying cylinder has a maximum extension from an entry point of the nip to an exit point of the nip. A carrier fabric is arranged to be capable of carrying a fibrous web from the forming section to the nip formed between the Yankee drying cylinder and the shoe roll and pass through the nip between the Yankee drying cylinder and the shoe roll together with the fibrous web. The carrier fabric is arranged to reach the outer circumference of the shoe roll at a first contact point such that the carrier fabric will wrap a part of the outer circumference of the shoe roll over an area stretching from the first contact point to the nip. The shoe roll further comprises a mechanical support located inside the loop of the flexible tubular belt and the mechanical support is placed to support the flexible tubular belt in at least a part of the area between the first contact point and the nip between the Yankee drying cylinder and the shoe roll. According to the invention, the carrier fabric wraps the outer circumference of the shoe roll in the area stretching from the first contact point by an angle which is greater than 80°. The shoe roll that forms a nip with the Yankee drying cylinder has axial ends connected to end walls such that the end walls and the flexible tubular belt define an enclosed space such that the shoe roll is an enclosed shoe roll. The paper making machine also comprises a source of pressurized air that can communicate with the enclosed space such that the enclosed space can be filled with pressurized air from the source of pressurized air. The carrier fabric is under tension and the tension in the carrier fabric lies in the range of 3.0 kN/m-5.0 kN/m, preferably in the range of 3.2 kN/m-5.0 kN/m and even more preferred in the range of 3.5 kN/m-5.0 kN/m. Furthermore, the mechanical support is arranged to support the flexible tubular belt in the area from the first contact point to the nip over an angle that is more than 90° and in the mechanical support ends at a point which, in the circumferential direction of the shoe roll, is closer to the entry point of the nip than to the exit point of the nip. At the maximum extension of the nip, the point at which the mechanical support ends is at an angular distance from the entry point of the nip which is at least 8° and preferably 10°-20°.

In preferred embodiments of the invention, the carrier fabric wraps the outer circumference of the shoe roll in an area stretching from the first contact point by an angle which is in the range of 100°-280° and preferably by an angle which is in the range of 100°-200° and even more preferred by an angle which is in the range of 120°-180°. However, embodiments are conceivable in which the wrap angle has other values. For example, embodiments are conceivable in which the wrap angle is only 95°.

In advantageous embodiments of the invention, the shoe is deformable such that the shape of a surface of the shoe that faces the Yankee drying cylinder in the nip between the Yankee drying cylinder and the shoe roll can adapt to match the outer surface of the Yankee drying cylinder. However, embodiments of the invention are conceivable in which the shoe is a substantially rigid element that cannot deform to adapt itself to the outer surface of the Yankee drying surface.

In preferred embodiments of the invention, at least one applicator for a lubricant, for example lubricant oil, is located inside the flexible tubular belt and arranged to be capable of applying a lubricant to an interior surface of the flexible tubular belt. Embodiments without a lubricant applicator are conceivable, for example if the interior surface are coated with a coating selected to reduce friction or if it is decided that a high degree of wear is acceptable, but the preferred solution is to use a lubricant applicator.

If an applicator for a lubricant is used, a trough may optionally be placed adjacent the shoe in an area which, in the circumferential direction of the shoe roll, lies between the entry point of the nip and the mechanical support such that lubricant fluid that enters the nip and is pressed backwards out of the nip can be collected in the trough.

In one advantageous embodiment of the inventive tissue paper making machine, the layout of the machine may be as follows. The forming section comprises a first forming fabric that is arranged to run in a loop supported by guide elements. The carrier fabric is a water-receiving felt which is used in the forming section as a second forming fabric that is arranged to run in a loop supported by guide elements and to carry the fibrous web from the forming section to the nip formed between the shoe roll and the Yankee drying cylinder. In this embodiment, the first forming fabric and the carrier fabric are so arranged in relation to each other that the two fabrics converge towards each other to form an inlet gap into which stock can be injected. The forming section comprises a head box that is arranged to inject stock into the inlet gap. A forming roll is arranged within the loop of the carrier fabric and is arranged to guide the carrier fabric into the inlet gap. The forming roll is also arranged to guide the carrier fabric and the first forming fabric along a part of their path which is common to both the carrier fabric and the first forming fabric and which begins at the inlet gap. In this embodiment of the invention, the forming roll comprises a flexible sleeve which is arranged to run in a loop around an axis of rotation that extends in a direction perpendicular to the direction in which the carrier fabric and the first forming fabric are arranged to run. The forming roll further comprises a support ledge located inside the loop of the flexible sleeve and extending in a direction parallel to the axis of rotation of the flexible sleeve. The support ledge is arranged to be capable of pressing the flexible sleeve in a direction outwards away from the axis of rotation of the flexible sleeve in an area along the loop in which the flexible sleeve is arranged to run such that, in the area in which the flexible sleeve is pressed outwards by the support ledge, the flexible sleeve is caused to follow a path with a radius of curvature which is smaller than the radius of curvature of the flexible sleeve outside the area in which the support ledge contacts the flexible sleeve.

In embodiments using a forming roll with a flexible sleeve and a support ledge, the radius of the forming roll in areas not in contact with the support ledge may be in the range of 500 mm-1600 mm and the smallest radius of the support ledge may be in the range of 40 mm-100 mm, preferably in the range of 45-80 mm and even more preferred in the range of 50 mm-75 mm.

In an alternative embodiment of the inventive tissue paper making machine, the layout of the machine may be as follows. The forming section comprises a first forming fabric arranged to run in a loop supported by guide elements and a second forming fabric which is likewise arranged to run in a loop supported by guide elements. In this embodiment, the carrier fabric is not used as a forming fabric but a fabric separate from the carrier fabric us used as a second forming fabric. The second forming fabric in this embodiment is a water-receiving felt and arranged so in relation to the first forming fabric that the two forming fabrics converge towards each other to form an inlet gap into which stock can be injected. A head box is arranged to inject stock into the inlet gap and a forming roll is arranged within the loop of the second forming fabric. In this embodiment of the invention, the tissue paper making machine comprises a pre-press that has an extended nip roll and a counter roll that forms a dewatering nip with the extended nip roll. The extended nip roll comprises a pressure shoe and a flexible jacket that loops the pressure shoe. The second forming fabric is arranged carry the fibrous web to the dewatering nip that is formed between the extended nip roll and the counter roll and to pass through the dewatering nip together with the fibrous web. The carrier fabric is arranged to pass through the dewatering nip and to carry the fibrous web from the dewatering nip to the nip formed between the shoe roll and the Yankee drying cylinder such that the fibrous web is transferred to the surface of the Yankee drying cylinder. In this embodiment, it is also so that the carrier fabric is a fabric that does not absorb water such that the nip between the shoe roll and the Yankee drying cylinder is a non-dewatering nip.

In the embodiment using a pre-press, the carrier fabric may be a water permeable structured fabric capable of imparting a three-dimensional structure onto the fibrous web as the carrier fabric passes through a nip. Alternatively, it may be a water impermeable belt which has a structured surface arranged to face the fibrous web such that a three-dimensional structure can be imparted onto the fibrous web as the carrier fabric passes through a nip. However, if the carrier fabric is a water impermeable belt, it may alternatively have a smooth surface that is arranged to face the fibrous web.

The invention also relates to a method of operating the inventive tissue paper making machine. According to the inventive method, the carrier fabric is caused to run at a speed in the range of 1500 m/s-2300 m/s.

The method may also comprise the step of feeding pressurized air to the enclosed space such that the enclosed space is kept at an overpressure in the range of 60 millibar-140 millibar, preferably in the range of 60 millibar-100 millibar.

DETAILED DESCRIPTION OF VARIOUS EMBODIMENTS

Figure 1:
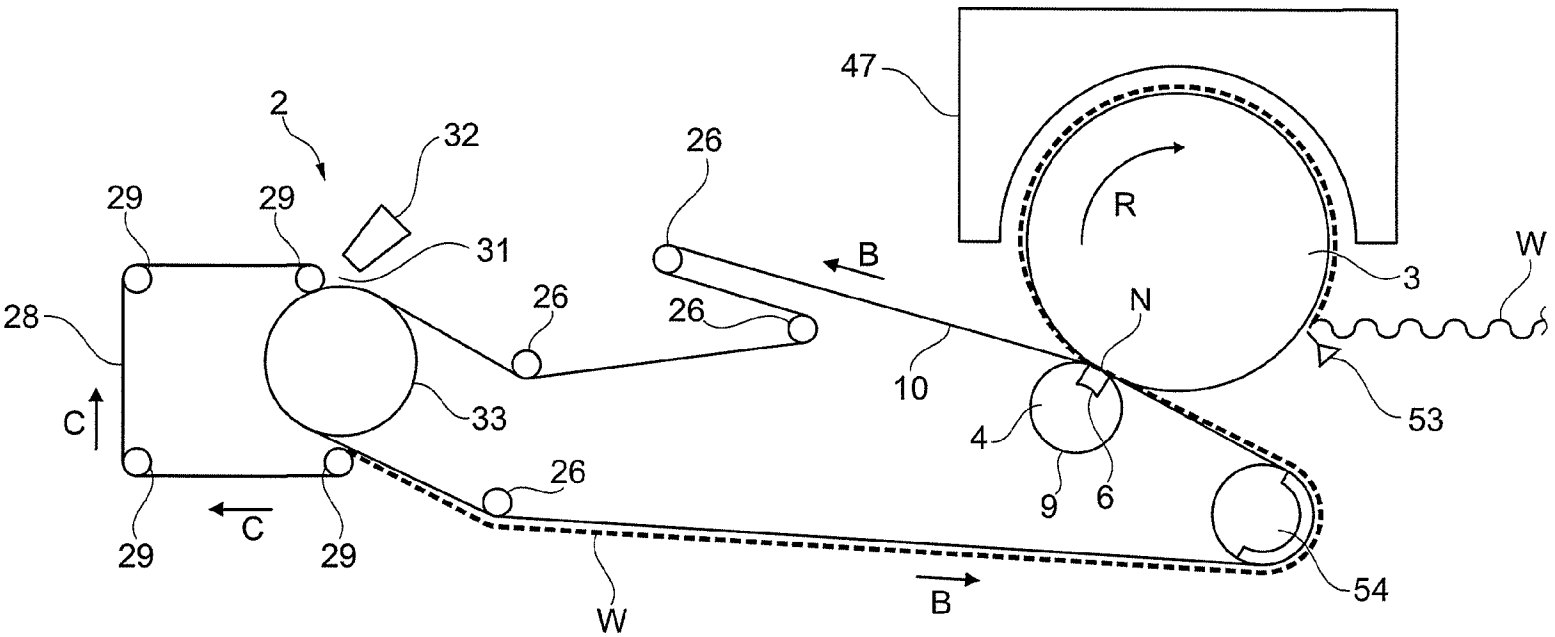
Fig. 1 (Prior Art)
FIG. 1 is a schematic side view representing a tissue paper making machine according to the prior art.

Reference will first be made to FIG. 1 which shows the layout of a known machine for making tissue paper. A machine with a substantially similar layout is known from, for example, U.S. Pat. No. 7,008,506. The paper making machine of FIG. 1 comprises a forming section 2 that comprises a first forming fabric 28 that is guided in a loop by guide rolls 28 and the first forming fabric 28 is arranged to be operated such that the first forming fabric 28 runs in the direction of the arrows C. The paper making machine of FIG. 1 further comprises a Yankee drying cylinder 3 which is used to remove water from a fibrous web W by means of heat and the Yankee drying cylinder 3 is typically heated from inside by hot steam. A carrier fabric 10 is arranged to carry a newly formed fibrous web W to the Yankee drying cylinder. The carrier fabric runs in a loop guided by guide rolls 26. During operation, the carrier fabric 10 runs in the direction of arrows B. In the machine according to FIG. 1, the carrier fabric 10 is at the same time used as a second forming fabric in the forming section 2 and the first forming fabric 28 and the carrier fabric 10 run together over a forming roll 33. The first forming fabric and the carrier fabric 10 are arranged to converge into an inlet gap 31 and a head box 32 is arranged to inject stock into the inlet gap 31 such that a fibrous web W can be formed between the fabrics 28 and 10. The first forming fabric 28 may be a foraminous wire and the carrier fabric 10 may be a water-absorbing felt. When the newly formed fibrous web leaves the area where the first forming fabric 28 and the carrier fabric 10 run together over the forming roll 33, the fibrous web W which still contains much water travels on the lower side of the carrier fabric 10 in the direction of arrow B towards a suction turning roll 54 while the first forming fabric 28 goes away from the wet fibrous web W. The fibrous web W passes around the suction roll 54 together with the carrier fabric 10 and the suction roll 54 serves to further dewater the fibrous web W through the carrier fabric 10. Here, it should be understood that the carrier fabric 10 is not water impermeable but water can pass through the carrier fabric 10 to at least some extent. The fibrous web W then travels from the suction turning roll 54 to a nip N formed between the Yankee drying cylinder 3 and a shoe roll 4 that is located inside the loop of the carrier fabric 10. The shoe roll 4 has a flexible tubular belt 9 and a shoe 6 arranged to act against the Yankee drying cylinder 3 to form the nip N. In the nip N, the fibrous web W is transferred to the outer surface of the Yankee drying cylinder 3 where it will be dried by heat coming from the inside of the Yankee drying cylinder 3. The ready-dried fibrous web may then be creped off from the surface of the Yankee drying cylinder 3 by means of a doctor 53 as is known in the art. It should be noted that, in FIG. 1, the Yankee drying cylinder 3 will be rotating in the direction of arrow R. A Yankee drying hood 47 may be arranged over the Yankee drying cylinder 2 to blow hot air against the fibrous web W and thereby contribute to drying the fibrous web W. In the machine according to FIG. 1, the suction roll 54 gives a significant contribution to dewatering of the fibrous web W such that the fibrous web reaches the nip N with a higher dryness than it would otherwise have had. The carrier fabric 10 is typically a water-absorbing felt that has a degree of permeability to both water and air and it is used also as a press fabric in the nip N against the Yankee drying cylinder. The nip N between the Yankee drying cylinder and the shoe roll 4 is thus both a transfer nip and a dewatering nip. In addition, the suction roll 54 also servers to guide the carrier fabric 10 such that it can reach the nip N against the Yankee drying cylinder at such an angle that it does not have to wrap the shoe roll 4 to a large extent. Therefore, the carrier fabric 10 will not interfere to any large extent with the flexible tubular belt 9 of the shoe roll 4.

The suction roll 54 thus serves two important function. However, suction rolls consume much energy and contribute to increasing the noise around the paper making machine. Moreover, the suction roll 54 also requires extra space, especially if it is used for guiding the path of the carrier fabric 10 since it must be placed at a suitable distance from the nip N between the shoe roll 4 and the Yankee drying cylinder 3. Therefore, it would be desirable to be able to use a layout without such a suction roll 54 before the nip N against the Yankee drying cylinder. In an alternative layout, without the suction roll 54, the carrier fabric would instead wrap a significant part of the circumference of the shoe roll 4.

Figure 2:
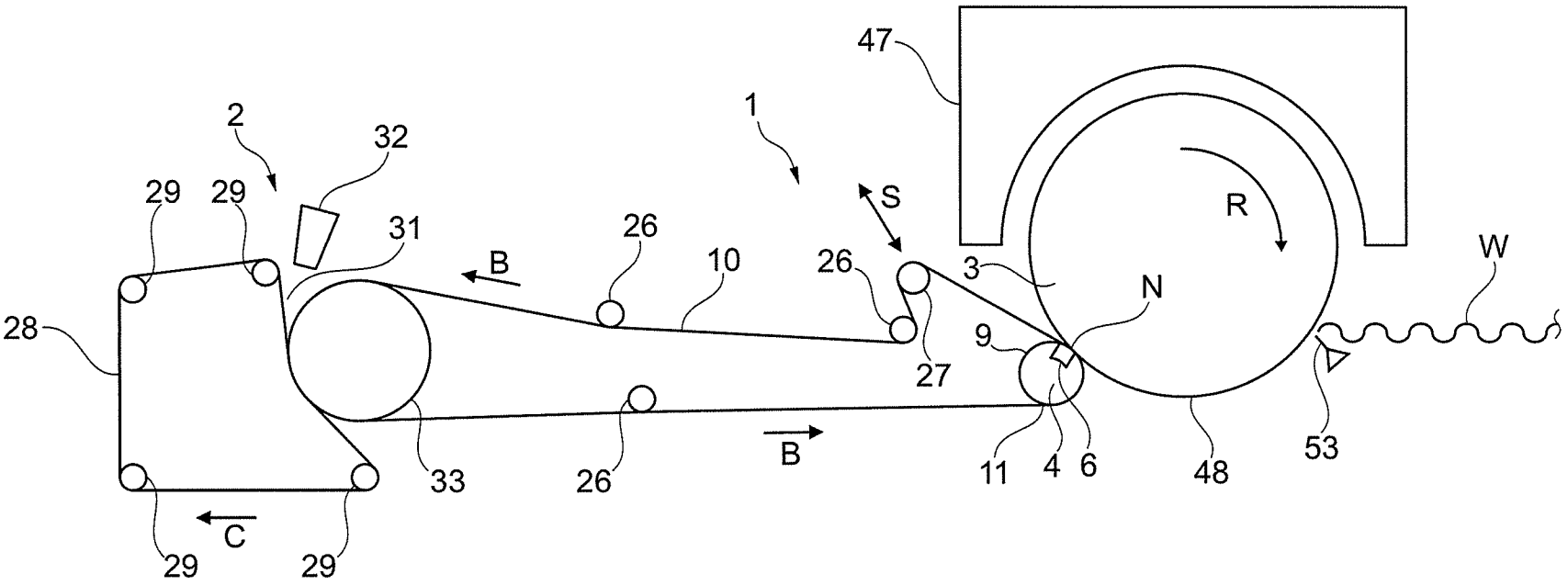
FIG. 2 is a figure similar to FIG. 1 but representing the machine layout according to a first embodiment of the present invention.

Reference will now be made to FIG. 2 that shows a layout of a tissue paper making machine 1 in which a separate suction roll 54 before the nip N between the shoe roll 4 and the Yankee drying cylinder 3 is not used. In FIG. 2, the reference numerals used for various details are the same as in FIG. 1. For example, the forming roll is still designated as by reference numeral 33, the shoe roll by reference numeral 4 etc.

In the layout according to FIG. 2, the carrier fabric 10 will inevitably wrap a significant part of the outer circumference of the shoe roll 4. When the carrier fabric 10 wraps a significant part of the shoe roll 4, the carrier fabric 10 may interfere with the flexible tubular belt 9 such that the shape of the flexible tubular belt 9 is deformed. Deformation of the belt 9 can have a negative impact in the nip N between the Yankee drying cylinder 3 and the shoe roll 4, especially if the belt 9 must make a sharp turn before entry into the nip N which can cause increased wear on the flexible tubular belt 9 and may also affect the course of pressing, at least in the beginning of the nip N against the Yankee drying cylinder.

To ensure that the flexible tubular belt 9 of a shoe press retains a correct form, shoe rolls may be designed such that the flexible tubular belt 9 has axial ends that are connected to end walls such that the end walls and the flexible tubular belt define an enclosed space. A source of pressurized air can then be connected to the shoe roll 4 and communicate with the enclosed space such that such that the enclosed space can be filled with pressurized air. In this way, the shoe roll 4 can be kept inflated in a way similar to how a balloon is inflated. An example of such a solution is disclosed in, for example, U.S. Pat. No. 5,084,137 and it is suggested in that document that the overpressure should be kept in the range of about 0.03-0.1 bars. Shoe rolls using the same or substantially the same solution for pressurizing the enclosed space as disclosed in U.S. Pat. No. 5,084,137 have also been sold to and used by many paper mills.

Keeping an enclosed space inside the shoe roll 4 can thus contribute to keeping the flexible tubular belt 9 in shape as is known by those skilled in the art of paper making.

However, in order to achieve a correct pressing procedure, it is also desirable that the carrier fabric 10 is kept at a certain level of tension. If the carrier fabric 10 that carries the fibrous web W to the nip N between the shoe roll 4 and the Yankee drying cylinder 3 is not under sufficient tension, there is a risk that the small wrinkles are formed on carrier fabric 10 and the fibrous web W pass through the nip N in a wrinkled state. The wrinkles do not have to be very large to produce adverse effects both on the actual pressing and on the transfer of the fibrous web W to the surface of the Yankee drying cylinder 3.

The inventors of the present invention have found that, in order to achieve a good transfer to the surface of the Yankee drying cylinder 3, the carrier fabric 10 needs to be kept at a tension of at least 3.0 kN/m and preferably at least 3.2 kN/m. Generally, tension levels higher than 3.0 kN/m are advantageous but tension levels higher than 5.0 kN/m are less desirable since most fabrics used in paper machinery tend to be worn out too quickly at levels higher than 5.0 kN/m are used. A suitable tension for the carrier fabric 10 will then normally be restricted to the range of 3.0 kN/m-5.0 kN/m.

The inventors have also found that, at tension levels in the range of 3.0 kN/m-5.0 kN/m, inflation of the shoe roll 4 is insufficient to prevent substantial deformation of the flexible tubular belt 9 that loops the shoe 6. In theory, it would be possible to simply increase the internal pressure inside the shoe roll 4 by feeding more compressed air into the enclosed space inside the shoe roll 4 and thereby preserve the shape of the shoe roll 4. However, increasing the internal pressure inside the shoe roll 4 above a certain level would lead to other undesirable effects. For example, the attachment/securement of the axial ends of the flexible tubular belt 9 to the end walls may give way such that the flexible tubular belt 9 was detached from the end walls which would cause the shoe roll 4 to collapse. The inventors have found that the internal overpressure in the enclosed space of the shoe roll 4 should be kept in the range of 0.04-0.12 bars, preferably in the range of 0.06-0.10 bars. If the overpressure in the enclosed space is lower than 0.04 bars, evacuation of lubricant fluid from the shoe roll 4 becomes more difficult (the overpressure in the enclosed space assists in evacuating lubricants from the enclosed space of the shoe roll). If the overpressure exceeds 0.12 bars, the risk that the flexible tubular belt 9 will come loose from its attachment to the end walls becomes too large.

The inventors have found that, when the carrier fabric 10 is kept at a tension of 3.0 kN or more, an internal overpressure in the shoe roll 4 of 0.12 bars is insufficient to retain a desired shape of the flexible tubular belt 9. Therefore, the inventors have concluded that an internal support is necessary in the region where the carrier fabric 10 wraps the outer circumference of the shoe roll 4.

One embodiment of the inventive tissue paper making machine 1 will now be explained with reference to FIG. 2, FIG. 3 and to FIG. 10.

As can be seen in FIG. 2, the inventive tissue paper making machine 1 comprises a forming section 2 and a Yankee drying cylinder 3. The Yankee drying cylinder may be a Yankee drying cylinder of any known type. For example, it could be a Yankee drying cylinder of cast iron or it may be a Yankee drying cylinder as disclosed in U.S. Pat. No. 8,438,752. Optionally, it may be a thermally insulated Yankee drying cylinder as disclosed in, for example, WO 2011/030363 A1.

Optionally, the paper making machine 1 is provided with a Yankee drying hood 47. The Yankee drying hood 47—if one is used—may be of such a design as disclosed in, for example, WO 2016/169915 A1 or U.S. Pat. No. 5,416,979 but many other designs of a Yankee drying hood 47 are conceivable.

The head box 32 used in the inventive machine may be, for example, such a head box as disclosed in EP 0 719 360 B1 but any kind of head box suitable for a tissue paper making machine may be used.

As can be seen in FIG. 2, a shoe roll 4 is arranged to form a nip N with the Yankee drying cylinder 3. As best seen in FIG. 3, the shoe roll 4 has a shoe 6 arranged to act against the Yankee drying cylinder 3 in the nip N formed between the shoe roll 4 and the Yankee drying cylinder 3. The nip N has a maximum extension (in the machine direction) from an entry point 7 of the nip to an exit point 8 of the nip. The extension of the nip N is determined by the length of that part of the shoe 6 that faces the Yankee drying cylinder 3. A flexible tubular belt 9 forms a loop around the shoe 6 and thereby also forms an outer circumference of the shoe roll 4.

Figure 10:
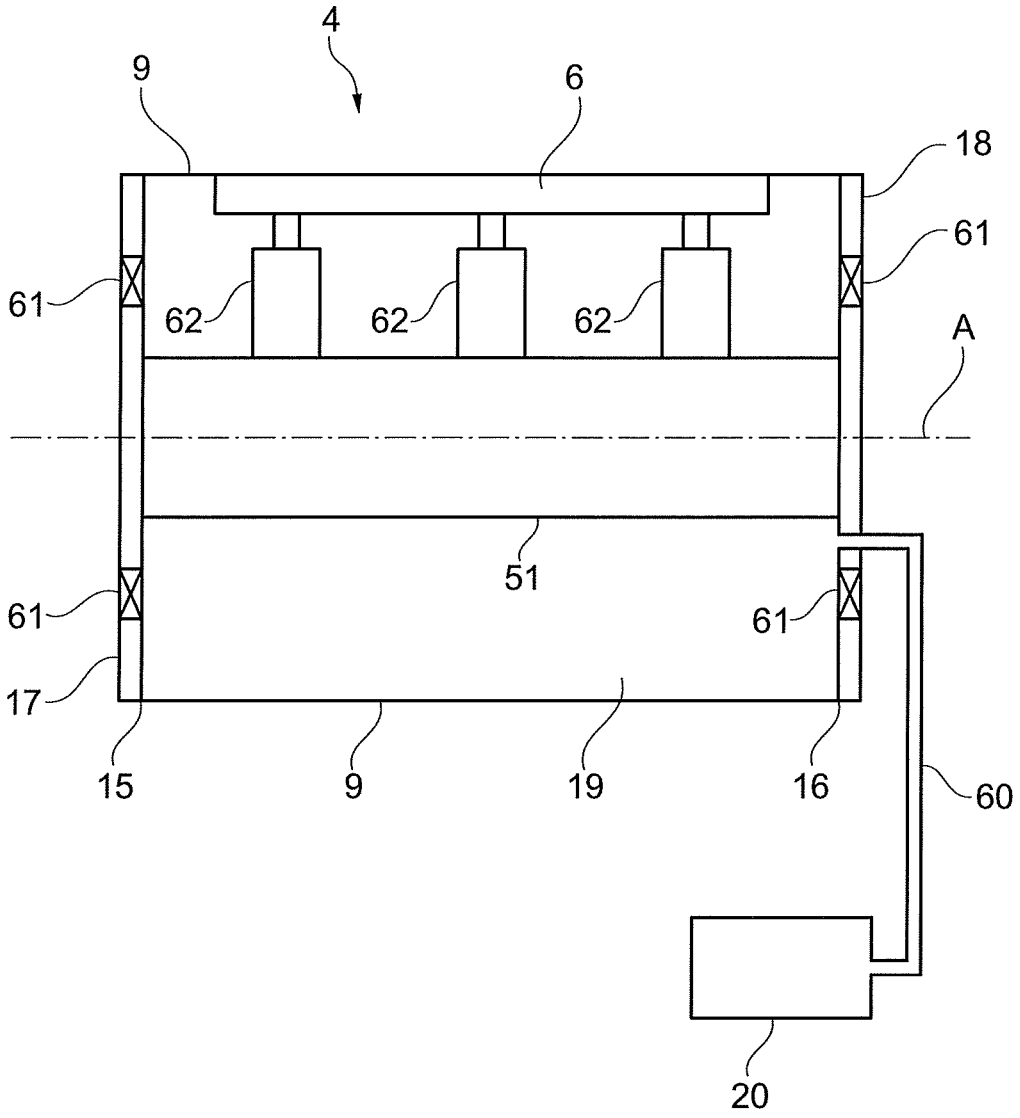
FIG. 10 shows, in longitudinal cross-section, a representation of the same shoe roll as in FIG. 3.

With reference to FIG. 10, it can be seen that the flexible tubular belt 9 of the shoe roll 4 has axial ends 15, 16 connected to end walls 17, 18. Thereby, the end walls 17, 18 and the flexible tubular belt 9 define an enclosed space 19. The paper making machine 1 further comprises a source 20 of pressurized air that can communicate with the enclosed space such that the enclosed space 19 can be filled with pressurized air. In this way, the flexible tubular belt 9 can be inflated and pressurized which contributes to maintaining the shape of the flexible tubular belt 9. The attachment or connection of the axial ends of the flexible tubular belt 9 to the end walls 17, 18 can be achieved in many different ways. Different solutions for achieving attachment/connection of the flexible tubular belt to the end walls are disclosed in, for example, EP 1873305 A2, U.S. Pat. Nos. 5,098,523 and 5,700,357 but the skilled person is aware that there are many other technical solutions that can be used. The end walls are journaled on the support beam 51 of the shoe roll 4 by bearings 61 that allow the end walls 17, 18 and the flexible tubular belt 9 to rotate about the support beam 51. In FIG. 10, the axis of rotation for the flexible tubular belt 9 is indicated as "A".

Embodiments are conceivable in which the shoe 6 of the shoe roll 4 is a substantially rigid shoe that can be made of a metallic material such as, for example, steel, aluminum or bronze. Such a shoe has a surface which, in the nip N against the Yankee drying cylinder 3, faces the Yankee drying cylinder 3 and is concave such that its shape matches the convex outer surface 48 of the Yankee drying cylinder (taking into account the thickness of the flexible tubular belt 9, the thickness of the carrier fabric 10 and the thickness of the fibrous web W). However, in preferred embodiments of the invention, the shoe 6 is deformable such that the shape of a surface of the shoe that faces the Yankee drying cylinder in the nip between the Yankee drying cylinder and the shoe roll can adapt to match the outer surface of the Yankee drying cylinder. Shoe rolls with such a shoe that can deform to match its shape to a counter roll (such as a Yankee drying cylinder) have been disclosed in, for example, U.S. Pat. No. 7,527,708. The shoe 6 and the means for pressing the shoe against a counter roll such as a Yankee drying cylinder may be designed as disclosed in U.S. Pat. No. 7,527,708 but other solutions are also possible. Another possible design of a shoe and means for pressing the shoe against a counter roll such as a Yankee drying cylinder is also disclosed in EP 2085513 B1 and such a solution could be used also in the present invention.

A carrier fabric 10 is arranged to be capable of carrying a fibrous web W from the forming section 2 to the nip formed between the Yankee drying cylinder 3 and the shoe roll 4 and pass through the nip between the Yankee drying cylinder 3 and the shoe roll 4 together with the fibrous web W. In the embodiment shown in FIG. 2, the carrier fabric 10 is also used as a forming fabric in the forming section 2. The carrier fabric 10 thus serves as a second forming fabric such that is cooperates with the first forming fabric 28 that may be a foraminous wire. Once the fibrous web W has been formed, the carrier fabric 10 separates from the first forming fabric 28 and carries the newly formed fibrous web W to the nip N between the shoe roll 4 and the Yankee drying cylinder 3 where the fibrous web W is pressed and transferred to the outer surface 48 of the Yankee drying cylinder 3. The carrier fabric 10 is arranged to reach the outer circumference of the shoe roll 4 at a first contact point 11 such that the carrier fabric 10 will wrap a part of the outer circumference of the shoe roll 4 over an area stretching from the first contact point 11 to the nip N, i.e. to the entry point of the nip. Of course, it should be understood that the carrier fabric will also wrap the shoe roll through the nip N itself to the exit point 8 of the nip and possibly also over a part of the outer circumference of the shoe roll 4 beyond the exit point 8 of the nip N.

The carrier fabric 10 is kept at a tension that lies in the range of 3.0 kN/m-5.0 kN/m in order to secure a reliable web transfer to the outer surface 48 of the Yankee drying cylinder 3. Preferably the carrier fabric 10 is kept at a tension that lies in the range of 3.2 kN/m-5.0 kN/m and even more preferred in the range of 3.5 kN/m-5.0 kN/m.

With reference to FIG. 2, a stretcher roll 27 can move back and for the as indicated by arrow S in order to increase or decrease the tension in the carrier fabric 10.

The shoe roll 4 further comprises a mechanical support 12 located inside the loop of the flexible tubular belt 9 which mechanical support 12 is placed to support the flexible tubular belt 9 in at least a part of the area between the first contact point 11 and the nip N between the Yankee drying cylinder 3 and the shoe roll 4. According to the invention, the carrier fabric 11 wraps the outer circumference of the shoe roll 4 in the area stretching from the first contact point 11 by an angle which is greater than 80°. The inventors have found that, in order to ensure that the flexible tubular belt retains its shape even when the carrier fabric is kept at a tension which is 3.0 kN/m or higher, the mechanical support 12 must give support to the flexible tubular belt 9 in the area from the first contact point 11 to the nip N over an angle that is more than 90 and the mechanical support is thus arranged to do this. However, the inventors have also determined that the mechanical support 12 should end at a certain distance from the entry to the nip N in order to ensure that the flexible tubular belt 9 is free to adapt to the change of geometry at the entry to the nip N. Therefore, the mechanical support 12 is shaped such that it ends at a point 13 which, in the circumferential direction of the shoe roll 4, is closer to the entry point 7 of the nip than to the exit point 8 of the nip and which, for the maximum extension of the nip, is at an angular distance from the entry point 7 of the nip which is at least 8° and preferably 10°-20° but not more than 30°, preferably not more than 25°.

Depending on where the entry point 11 is located, i.e. the point at which the carrier fabric 10 first reaches the shoe roll 4, the mechanical support 12 may be so designed and so placed within the shoe roll 4 that it supports the flexible tubular belt 9 over an angle that is much larger than 80°. For example, it may be designed such that it supports the flexible tubular belt 9 over an angle that is 110°, 120° or even 180°. However, it may often be desirable that the layout of the machine 1 is such that the carrier fabric 10 travels along a substantially horizontal path to the shoe roll 4. The first contact point 11 will then be located at the vertically lowest point on the circumference of the shoe roll 4. In many realistic embodiments, the mechanical support 12 may then be designed and arranged to support the flexible tubular belt 9 over an angle in the range of 95°-120° or 100°-115°.

In advantageous embodiments, a trough 24 may optionally be placed adjacent the shoe 6 in an area which, in the circumferential direction of the shoe roll 4, lies between the entry point of the nip 7 and the mechanical support 12 such that lubricant fluid that enters the nip and is pressed backwards out of the nip can be collected in the trough 24. By ending the mechanical support 12 at a certain distance from the nip N, it also becomes easier to fit a trough 25 adjacent the shoe 6 to collect a lubricant (for example a lubricant oil) that has been pressed out of the nip N.

The mechanical support 12 may comprise a guide shoe that is curved to correspond to the radius of curvature of the flexible tubular belt, i.e. to match the curvature of the flexible tubular belt such that the flexible tubular belt 9 can glide on the mechanical support 12. With reference to FIG. 3, the mechanical support 12 may be shaped as a continuous curved shoe. The curved shoe may have substantially the same width in the cross machine direction as the shoe 6. However, embodiments are also conceivable in which several such curved shoes are placed spaced from each other in the cross machine direction CD. The spacing between different curved shoes may be on the order of, for example, 2 cm-25 cm but other spacings are also conceivable. If the mechanical support 12 comprises one or several such curved shoes, the shoe or shoes will have a curvature that matches the curvature of the inner surface 22 of the flexible tubular belt 9 when the flexible tubular belt 9 is inflated by pressurized air. Instead of curved shoes, the mechanical support 12 may comprise rollers that as disclosed in U.S. Pat. No. 6,004,429.

Figure 3:
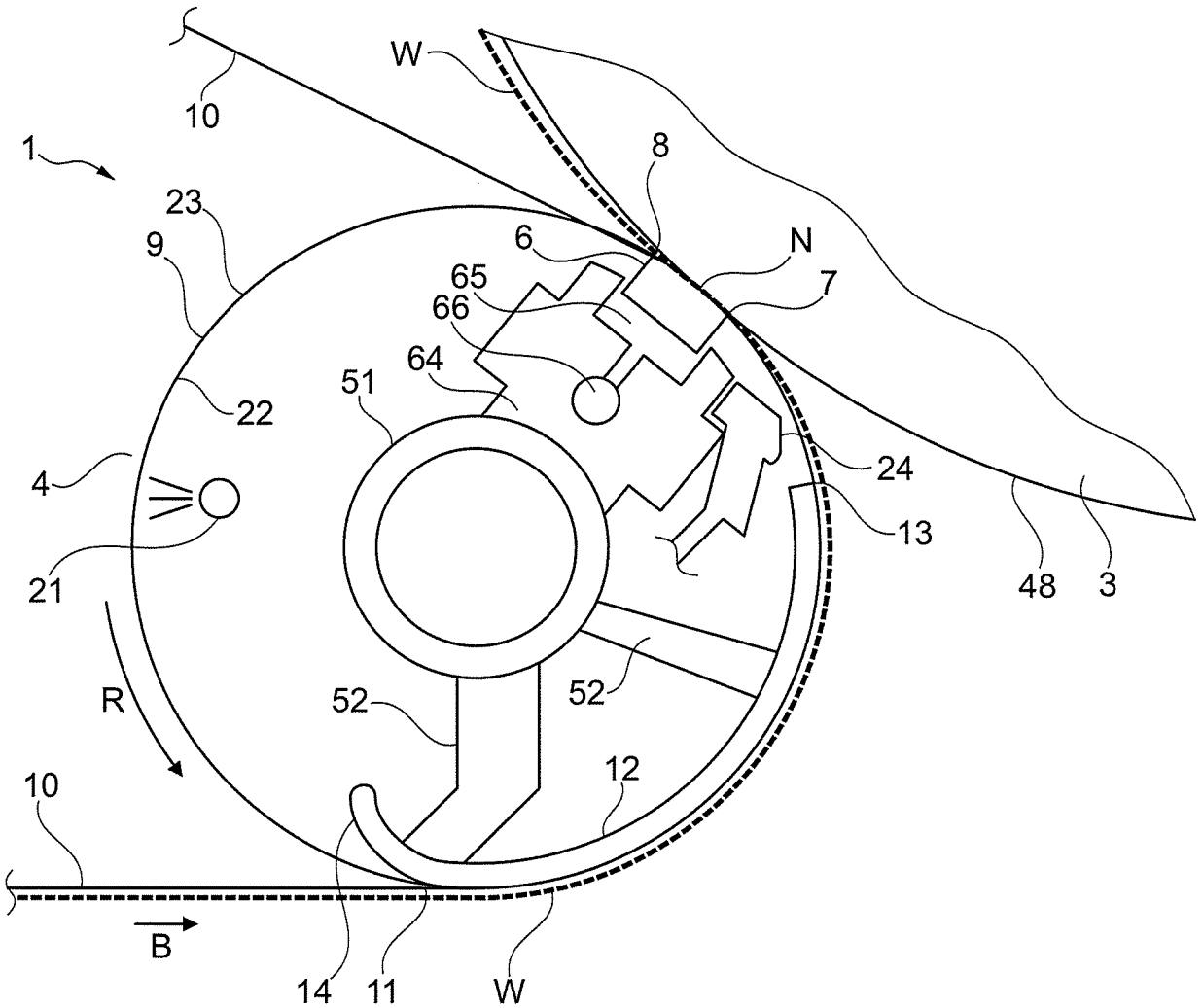
FIG. 3 shows, in cross section, a side view of a shoe roll designed for the present invention.

With reference to FIG. 3, it can be seen that the shoe roll 4 may be designed such that the support beam 51 carries the mechanical support 12 by means of arms 52 that are connected to the support beam 51 and to the mechanical support 12. The shoe roll 4 may further be designed such that it carries a holder 64 for the shoe 6. In the holder 64, there may be an inner cavity 65 which may function as a cylinder for the shoe 6 that can move inside the cavity 65. The cavity 65 may be fed with pressurized fluid such as oil through a channel 66 in the holder 64. When pressurized fluid is fed to the cavity 65, the shoe 6 will be pressed against the Yankee drying cylinder 3. It should be understood that the particular arrangement of FIG. 3 with the holder 64, the cavity 65 and the channel 66 represents only one possible way of causing the shoe 6 to be pressed against the Yankee drying cylinder 3 and the skilled person is well aware that there are many other ways of achieving this function. Some examples of this are disclosed in, for example, U.S. Pat. No. 7,527,708, EP 2085513 B1 and EP 2808442 B1 but other known solutions may also be used.

A mechanical support 12 having one or several curved shoes may be designed such that the shoe (or shoes) has (have) an initial part 14 that is curved away from the inner surface 22 of the flexible tubular belt 9. In this way, the flexible tubular belt 9 can meet the mechanical support 12 gradually such that there is no risk of a sudden impact that might damage the flexible tubular belt.

In preferred embodiments of the invention, the carrier fabric 10 wraps the outer circumference of the shoe roll in an area stretching from the first contact point by an angle which is in the range of 100°-280° and preferably by an angle which is in the range of 100°-200° and even more preferred by an angle which is in the range of 120°-180°.

In preferred embodiments of the invention, at least one applicator 21 for lubricant is located inside the flexible tubular belt 9 and arranged to be capable of applying a lubricant to an interior surface 22 of the flexible tubular belt 9.

In order for the paper making machine 1 to achieve a high dryness without using more heat energy for evaporation, it is desirable that the dryness of the fibrous web W that reaches the nip N between the shoe roll 4 and the Yankee drying cylinder 3 already has a certain dryness, even when a suction roll is not used before the nip N with the shoe roil 4. Therefore, in preferred embodiments of the invention, the machine 1 should be designed such that a reasonably high dryness can be achieved before the nip N between the shoe roll 4 and the Yankee drying cylinder 3 even though no suction roll is used.

A possible embodiment of the inventive machine will now be described with reference to FIG. 2 and to FIGS. 4-9.

Figure 4:
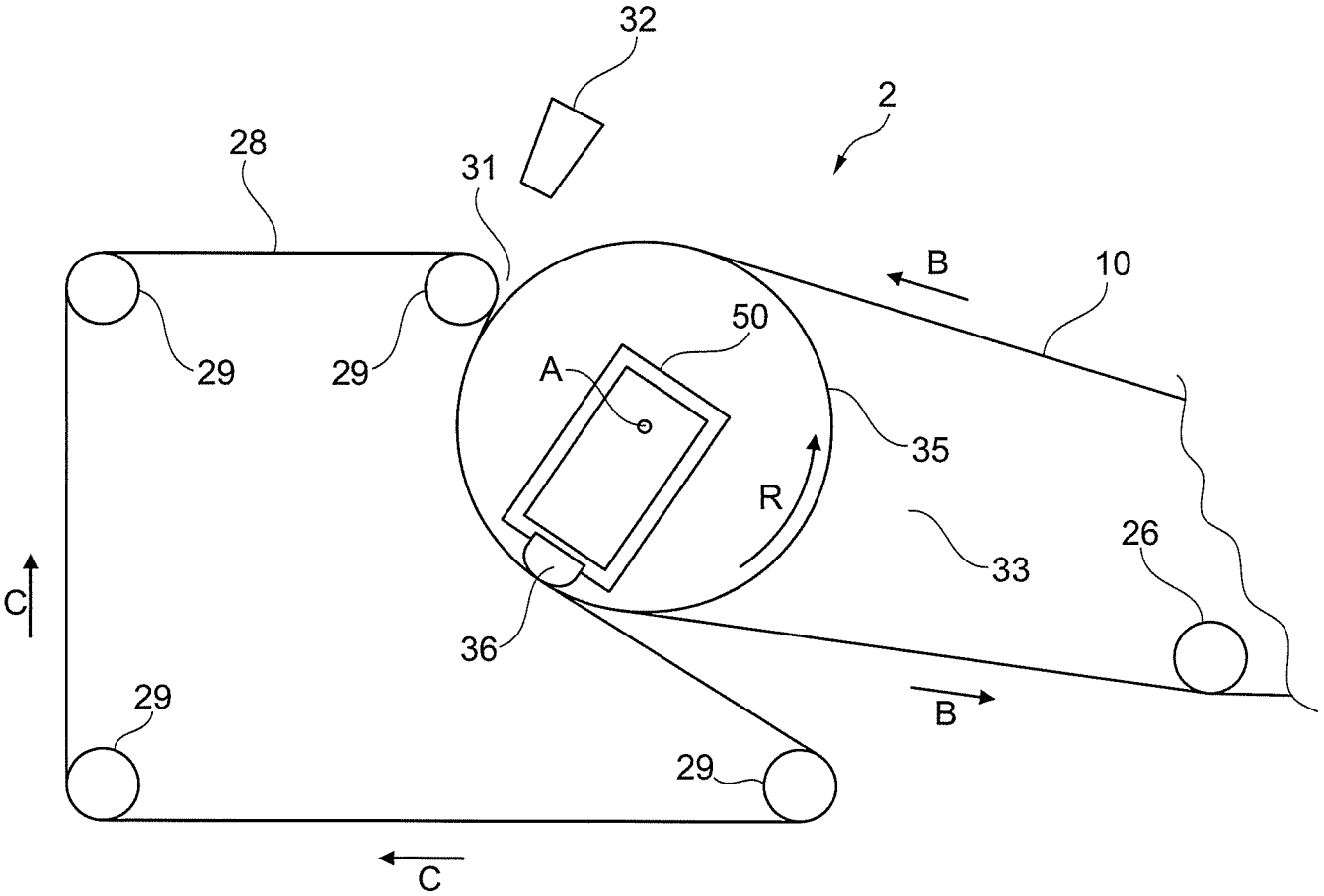
FIG. 4 shows, in cross section, a side view of a part of a forming section according to one embodiment of the present invention which uses a specially designed forming roll.

With reference to FIG. 2, the forming section 2 comprises a first forming fabric 28 that is arranged to run in a loop supported by guide elements 29 a carrier fabric 10 which is a water-receiving felt is used in the forming section 2 as a second forming fabric that is arranged to run in a loop supported by guide elements 26 and to carry the fibrous web W from the forming section 2 to the nip formed between the shoe roll 4 and the Yankee drying cylinder 3. With reference to FIG. 4, the first forming fabric 28 and the carrier fabric 10 are so arranged in relation to each other that the two fabrics 10, 28 converge towards each other to form an inlet gap 31 into which stock can be injected. The forming section 2 further comprises a head box 32 arranged to inject stock into the inlet gap 31 and a forming roll 33 is arranged within the loop of the carrier fabric 10. The forming roll 33 is arranged to guide the carrier fabric 10 into the inlet gap 31 and to guide the carrier fabric 10 and the first forming fabric 28 along a part of their path which is common to both the carrier fabric 10 and the first forming fabric 28 and which begins at the inlet gap 31. The forming roll 33 is designed such that it comprises a flexible sleeve 35 which is arranged to run in a loop around an axis of rotation A that extends in a direction perpendicular to the direction in which the carrier fabric 10 and the first forming fabric 28 are arranged to run. The forming roll 33 further comprises a support ledge 36 located inside the loop of the flexible sleeve 35 and extending in a direction parallel to the axis of rotation of the flexible sleeve 35. The support ledge 36 is arranged to be capable of pressing the flexible sleeve 35 in a direction outwards away from the axis of rotation of the flexible sleeve 35 in an area along the loop in which the flexible sleeve 35 is arranged to run. Thereby, in the area in which the flexible sleeve 35 is pressed outwards by the support ledge 36, the flexible sleeve 35 is caused to follow a path with a radius of curvature which is smaller than the radius of curvature of the flexible sleeve 35 outside the area in which the support ledge 36 contacts the flexible sleeve 35.

The function of the forming roll 33 according to the embodiment of FIGS. 4-9 will be explained in the following. The amount of water that is squeezed or pressed out of the stock as the stock travels between the first forming fabric 28 and the carrier fabric 10 (which functions as a forming fabric in this embodiment) in that part of their respective paths that is common to both fabrics 28, 10 depends to a large extent of the pressure to which the stock is subjected. The pressure to which the stock is subjected can be calculated as $P=T/R$ where P is the pressure to which the stock is subjected, T is the tension in the first forming fabric 28 and R is the radius of the forming roll 33. It follows that a small radius R results in a higher pressure than a larger radius. In theory, it would be possible to increase the pressure simply by using a small forming roll 33 with a correspondingly small radius. However, experience has showed that the draining zone, i.e. the part where the stock travels between forming fabrics needs to have a certain length. Therefore, a forming section 2 with a forming roll 33 that is too small would be insufficient. Likewise, the tension in the fabrics can be increased but there are technical problems also with such a solution, for example the amount of tension to which the fabrics can be subjected. Therefore, it is difficult to achieve a dry solids content during forming that is much higher than about 12%. With such a low dry solids content, it is normally difficult to subject the fibrous web W to pressing since the web W would then risk crushing. Therefore, in order to increase web dryness before pressing, a suction roll has often been placed in the loop of the fabric that carries the fibrous web W to the nip N against the Yankee drying cylinder 3. Such a suction roll can act through the carrier fabric 10 at a point after the first forming fabric 28 and the carrier fabric 10 have been separated from each other. An example of such a solution is disclosed in WO 2010/033072 and FIG. 1 of that publication shows a suction roll 25 placed inside the loop of the forming fabric that carries a newly formed web to a press. It has also been suggested that the forming roll itself may be a suction roll and an example of such an arrangement is disclosed in U.S. Pat. No. 6,821,391 in which FIG. 2 shows a forming section with a forming roll 18 that is a suction roll with a suction zone. However, as already mentioned, suction rolls require much energy for their operation which of course also costs money. In addition, suction rolls make noise. Therefore, it is desirable to find a solution that can give a higher dry solids content during forming even when a suction roll is not used. In the embodiment of FIGS. 4-9, a solution to this technical problem is shown.

Figure 5:
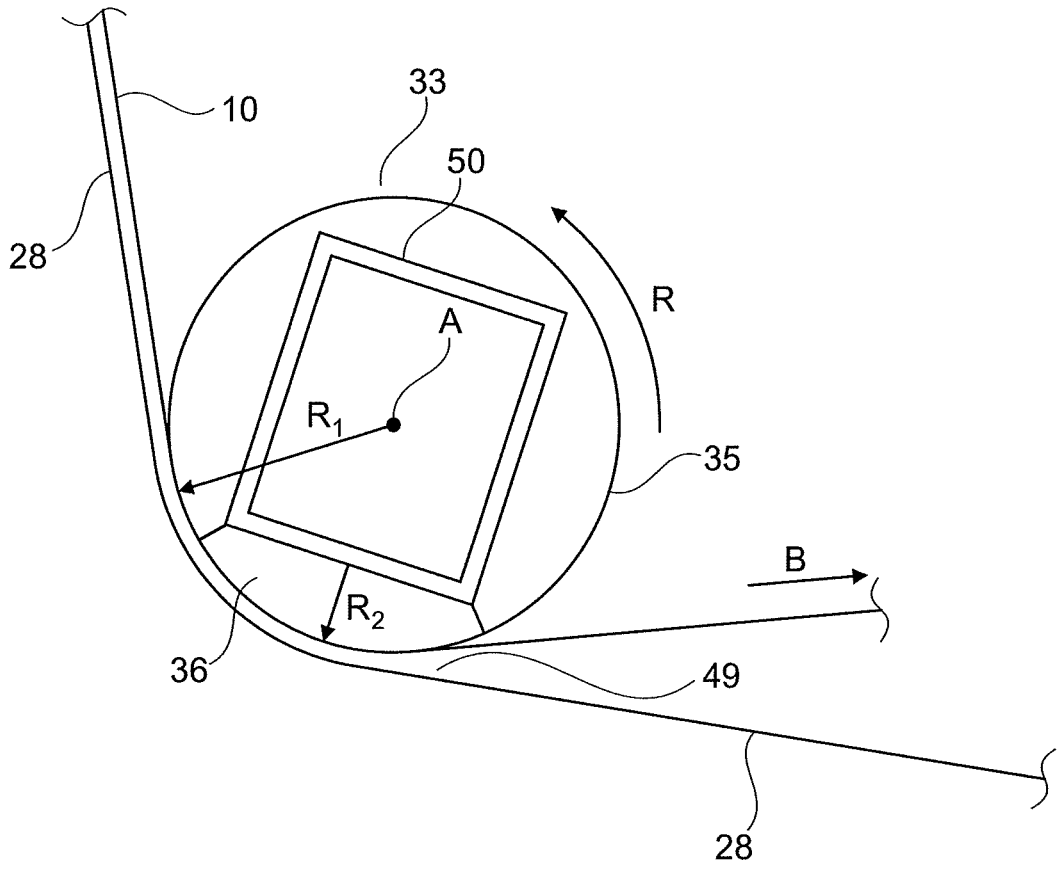
FIG. 5 is a figure similar to FIG. 4 but showing some elements in greater detail.

Reference will now be made to FIG. 4 and FIG. 5.

In FIG. 4, it can be seen how the forming roll 33 has a shell. The shell is a flexible sleeve 35 which may alternatively be referred to as a "tubular jacket". The flexible sleeve 35 may very well be substantially similar to the flexible tubular belt 9 of the shoe roll 4 and possibly even be of identical design. The flexible sleeve 35 may advantageously be made of polyurethane or a material that partially comprises polyurethane or has material properties similar to those of polyurethane. The flexible sleeve 35 is arranged to run in a loop around an axis of rotation A. In other words, the flexible sleeve 35 is arranged to rotate. It should be understood that the flexible sleeve 35 may advantageously be designed and arranged such that it is connected to end walls in just the same way as the flexible tubular belt 9 of the shoe roll 4 and the end walls may be rotatably journaled onto a support beam 50 in the same way as shown in FIG. 10 with reference to the shoe roll 4. The forming roll 33 may thus have a design that is very similar to that of the shoe roll 4 and it may also be connected to a source of pressurized air such that it can be inflated very much as the flexible tubular belt 9 of the shoe roll 4. It should be understood that, in FIG. 4, the flexible sleeve 35 will be rotating in the direction indicated by the arrow R. It should likewise be understood that, just as in FIG. 1, the first forming fabric 28 moves in the direction indicated by the arrows C and the carrier fabric 10 which functions as a forming fabric moves in the direction indicated by the arrows B. It should be understood that the axis of rotation A for the flexible sleeve 35 extends in a direction that is perpendicular to the direction in which the first forming fabric 28 and the carrier fabric 10 are arranged to run, i.e. it extends in the cross machine direction, of the forming section 2. It should be understood that, in FIG. 4, the flexible tubular jacket will rotate in the direction of arrow R when the forming section 2 is operating. The actual thickness of the flexible sleeve 35 may be selected while taking the choice of material into consideration and factors such as machine speed, machine width and other factors. However, in many realistic embodiments, the flexible sleeve 35 may have a thickness in the range of 2-7 mm. For example, it may have a thickness that is 3 mm, 4 mm or 5 mm. The flexible sleeve 35 may also comprise several layers of different materials. As can be seen in FIG. 4, the forming roll 33 further comprises a support ledge 36 that is located inside the loop of the flexible sleeve 35 and extends in a direction parallel to the axis of rotation A of the flexible sleeve 35. Of course, the flexible sleeve 35 itself extends in the same direction.

The support ledge 36 is arranged to be capable of pressing the flexible sleeve 35 in a direction outwards away from the axis of rotation A of the flexible sleeve 35 in an area along the loop in which the flexible sleeve 35 is arranged to run. This has the result that, in the area in which the flexible sleeve 35 is pressed outwards by the support ledge 36, the flexible sleeve 35 is caused to follow a path with a radius of curvature which is smaller than the radius of curvature of the flexible sleeve 35 outside the area in which the support ledge 36 contacts the flexible sleeve 35.

In the embodiment of FIG. 4, the support ledge 35 is supported by a support beam 50 to which the support ledge 36 is directly or indirectly fastened. The support beam 50 may be a welded box beam but other sorts of support beams 50 could also be used, for example a support beam of cast iron.

The flexible sleeve 35 is preferably impermeable to water but embodiments are conceivable in which the flexible sleeve is permeable to water. If the flexible sleeve 35 is impermeable to water, which it preferably is, this assists in making the water in the stock pass out through the first forming fabric 28.

From the above description, those skilled in the art to which the invention pertains will now understand that the forming roll 33 with the flexible sleeve 35 is substantially similar to a shoe press unit such as a shoe press roll. Such units are sold commercially under such trade names as SymBelt™ shoe press or NipcoFlex shoe press and have been described in many patent publications, for example in U.S. Pat. No. 7,387,710 or 5,662,777. The support ledge 36 could alternatively be termed "shoe" since it is placed in the position where a shoe would be placed in a shoe press unit. However, while the support ledge 36 of the forming roll 33 is used in connection with dewatering while a certain pressure is applied as the first forming fabric 28 and the carrier fabric 10 pass over the support ledge 36, the purpose of the support ledge 36 differs from that of a shoe in a shoe press as will be explained in the following.

Since the support ledge 36 is capable of pressing the flexible sleeve 35 outwards, it can achieve the effect that, over a part of the circumference of the flexible sleeve 35, the radius becomes smaller. Over that part of the circumference of the flexible sleeve 35, the pressure to which the stock is subjected will rise and have a peak that it would otherwise not have. The support ledge 36 is arranged to or capable of pressing the flexible sleeve 35 out from the path it follows at those parts of its circumference where it does not pass over the support ledge 36. As the support ledge 36 does this, it forces the flexible sleeve 35, the forming fabric 28 and the carrier fabric 10 to follow a path where the radius over which the fabrics 28, 10 pass is actually smaller than what is the case at other points along the circumference of the flexible sleeve 35. As a result, the pressure to which the stock is subjected increases as the fabrics 28, 10 pass over that part of the forming roll 33 where the support ledge 36 is acting.

With reference to FIG. 5, the first forming fabric 28 and the carrier fabric 10 are caused to run together around the forming roll 33. Initially, they follow a curve defined by a first radius $R_1$ of the forming roll 33. The radius $R_1$ may be understood as the radius from the axis of rotation A of the flexible sleeve 35. As the fabrics 28, 10 pass over the support ledge 36, they will be forced to follow a curve with a radius $R_2$ which is defined by the shape of the support ledge 36. The radius $R_2$ is smaller than the radius $R_1$ (i.e. $R_2<R_1$) and the pressure will thus increase such that the dewatering is intensified as the first forming fabric 28 and the carrier fabric 10 pass over the support ledge 36. It should be understood that the radius of the support ledge 36 may vary in the machine direction from the upstream end of the support ledge 36 to the downstream end of the support ledge 36.

In some embodiments, the support ledge 36 can be arranged in a fixed position such that the amount to which the flexible sleeve 35 is pressed outwards by the support ledge 36 is constant. For example, the support ledge 36 may be directly supported by or integral with a support beam 50 located inside the loop of the flexible sleeve 35 and remain fixed in position in relation to the support beam 50.

Figure 6:
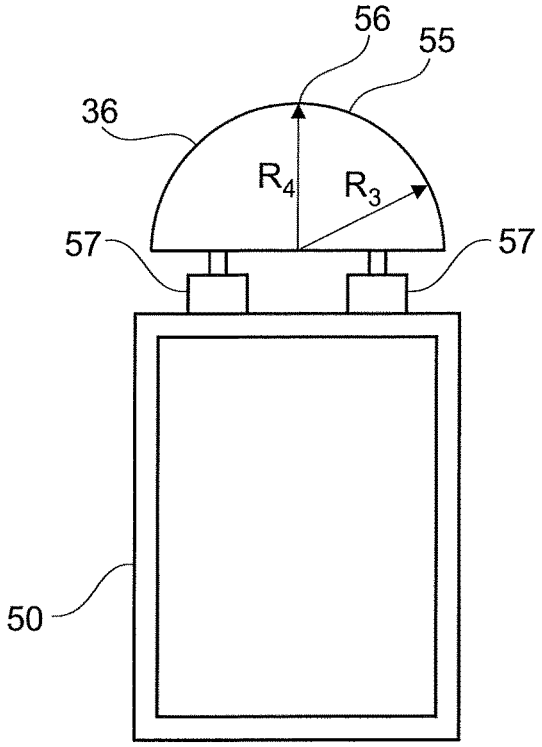
FIG. 6 shows a possible embodiment of a component belonging to the embodiment of FIG. 4.

Instead of a support ledge 36 that is held in a fixed position, it could be so that at least a part of the support ledge 36 is arranged to be movable towards or away from the axis of rotation A of the flexible sleeve 35 such that the amount to which the flexible sleeve 35 is pressed outwards by the support ledge 36 can be varied. Possible embodiments of such an arrangement will now be explained with reference to FIGS. 6-8. In FIG. 6, a support ledge is shown that is supported by a support beam 50. In FIG. 6, two actuators 57 are shown and the actuators 57 may be hydraulic cylinders as is known from shoe press technology. The actuators 57 are supported by and fixed/secured to the support beam 50 and the actuators 57 are arranged to be capable of acting on the support ledge 36 to press it outwards and thereby also press the flexible sleeve 35 outwards. It should be understood that the two actuators 57 that are shown in FIG. 6 may represent two rows of actuators that extend in the cross machine direction. An alternative embodiment is shown in FIG. 7.

Figure 7:
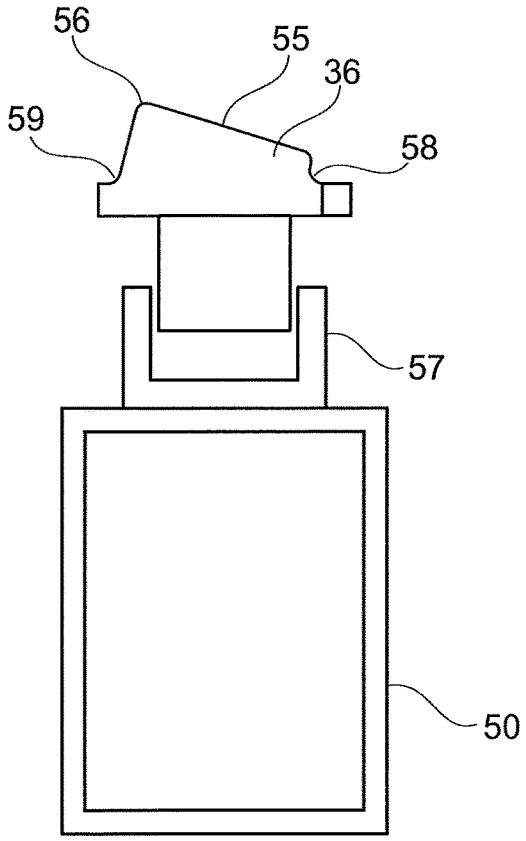
FIG. 7 is a figure similar to FIG. 6 but showing another possible embodiment of the same component.

It should be understood that the actuator (or actuators) 57 of FIG. 6 and FIG. 7 may very well be formed as a single actuator extending in the cross-machine direction (the CD direction) which may even be integral with the support ledge 36. Such a design of an actuator is known from, for example, U.S. Pat. No. 5,223,100 that relates to a shoe press but a similar arrangement may be used also for the forming roll 33 according to one embodiment of the present invention. If several actuators 57 are used, the arrangement and design of the actuators 57 could be similar to or identical to any known arrangement of actuators for a shoe in a shoe press. For example, the actuator or actuators could be designed and arranged as disclosed in U.S. Pat. Nos. 5,662,777, 6,083, 352, 10 7,387,710, 4,917,768 or European patent No. 2808442. However, other actuator arrangements for shoe presses are also known from the patent literature and from what is commercially available on the market and those skilled in the art of paper making can select among known solutions for actuators.

Figure 8:
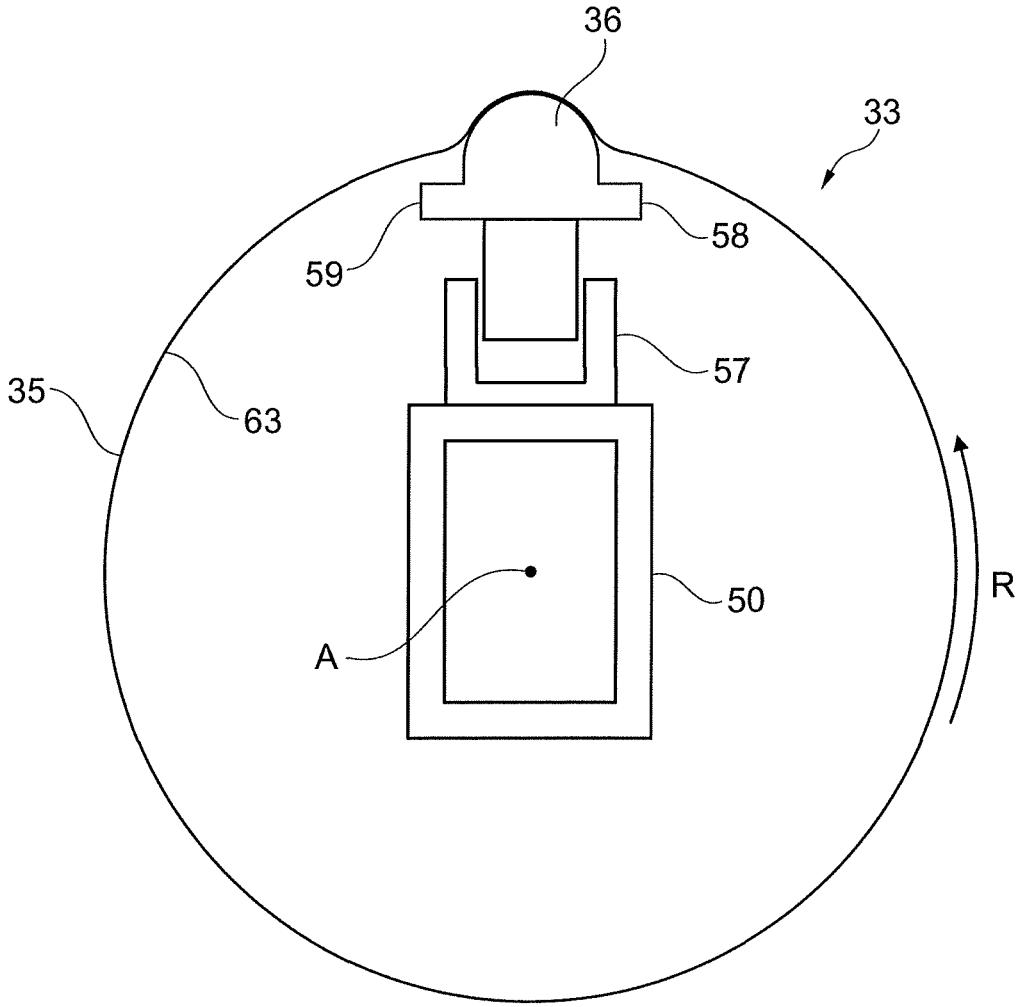
FIG. 8 is a figure showing the same component as in FIG. 6 and FIG. 7 but in a slightly different form and also showing the flexible sleeve looping the component in question.

With continued reference to FIGS. 6, 7 and 8, it can be seen that the support ledge 36 has a top surface 55 which is facing the inner surface 63 of the flexible sleeve 35 (see FIG. 8) and contacts the inner surface 63 of the flexible sleeve 35, at least when the forming section 2 of this embodiment is operating. In the embodiment of FIG. 6 and FIG. 8, the top surface 55 is convex and the top surface 55 of the support ledge 36 (i.e. the surface that faces the inner surface of the flexible sleeve 35) has a varying radius such that, as the flexible sleeve 35 moves over the support ledge 36 from an end adjacent the inlet gap to a point further away from the inlet gap, the radius of the support ledge 36 will decrease from a greater radius to a smaller radius. In FIG. 6, it can be seen that, at one end of the support ledge 36, the support ledge 36 (or the top surface 55 of the support ledge) has a radius $R_3$. The top surface 55 has a peak point 56, i.e. the highest point on the top surface that is at the greatest distance from the axis of rotation A of the flexible sleeve 35. At the peak point 56, the radius $R_4$ of the support ledge (i.e. the radius of its top surface 55) is smaller such that $R_4<R_3$. The radius of the support ledge 36 will thus decrease from a higher value to a smaller value which is reached when the amount to which the flexible tubular jacket is pressed outwards from its otherwise circular path reaches its maximum. This will lead to a peak in the pressure to which the stock between the first forming fabric 28 and the carrier fabric 10 is subjected and the dewatering will increase.

Reference will now be made only to FIG. 7. In the embodiment of FIG. 7, the support ledge 36 is designed such that, in the direction of rotation of the flexible sleeve 35 (see FIG. 8 in which the arrow R indicates the direction of rotation of the flexible tubular jacket 35), the top surface 55 of the support ledge 36 increases in height to a peak point 56 that is closer to the downstream end 59 of the support ledge than to the upstream end 58. In this way, the pressure peak 56 is not reached until the end of the area of the support ledge 36 and the pressure is built up gradually until it goes down after the peak point 56. By this design of the support ledge 36, a sudden pressure pulse can be avoided which might otherwise have damaged the fibrous web W that is forming.

The radius of the forming roll 33 in areas not in contact with the support ledge 36 may be in the range of 500 mm-1600 mm and the smallest radius of the support ledge 36 may be in the range of 40 mm-100 mm, preferably in the range of 45-80 mm and even more preferred in the range of 50 mm-75 mm.

Figure 9:
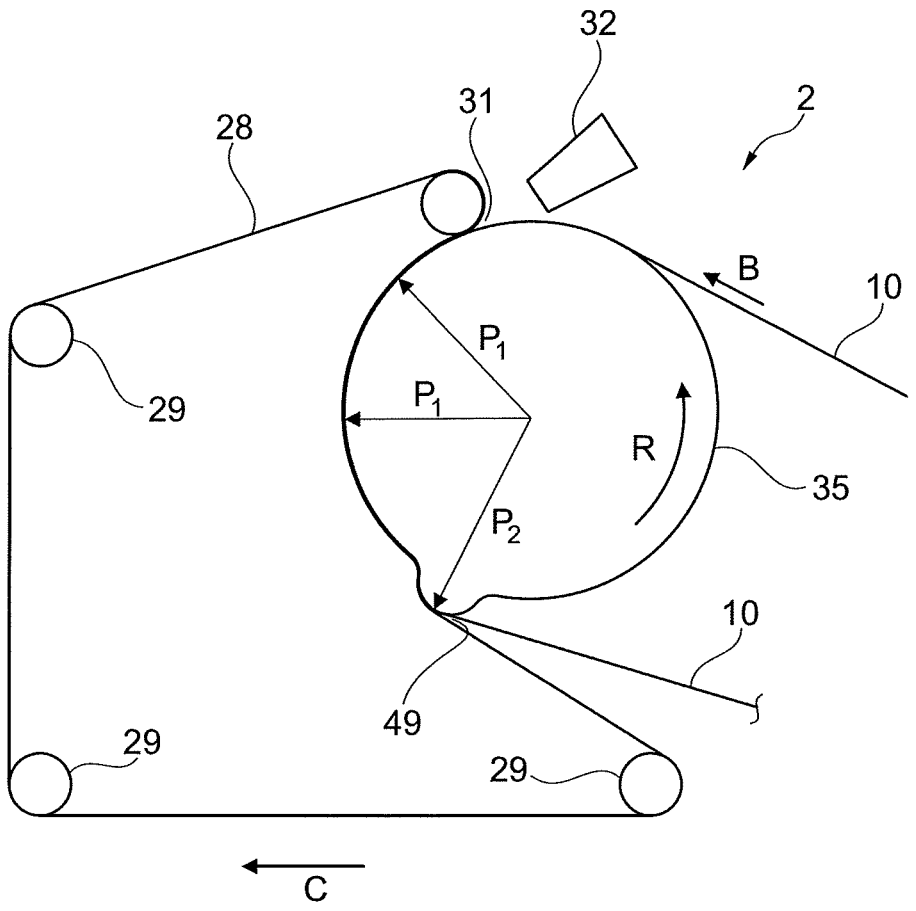
FIG. 9 is a schematic representation of varying pressure along the forming roll of FIG. 4.

With reference to FIG. 9, it can be seen that the pressure exerted on the stock between the first forming fabric 28 and the carrier fabric 10 has a values $P_1$ in the area before the fabrics 28, 10 reach the support ledge 36. As the fabrics 28, 10 reach the area of the support ledge 36, the pressure increases due to the smaller radius and the pressure increases to a level $P_2$ where the pressure $P_2$ is higher than the pressure $P_1$. As a result, the dewatering increases. Thanks to the special design of the forming roll shown in FIGS. 4-9, the fibrous web W will have an increased dryness when it reaches the nip N between the shoe roll 4 and the Yankee drying cylinder 3, even if the fibrous web W does not pass a suction roll. The fibrous web W may then be subjected to a higher pressure in the nip N against the Yankee drying cylinder 3 without being crushed.

Figure 11:
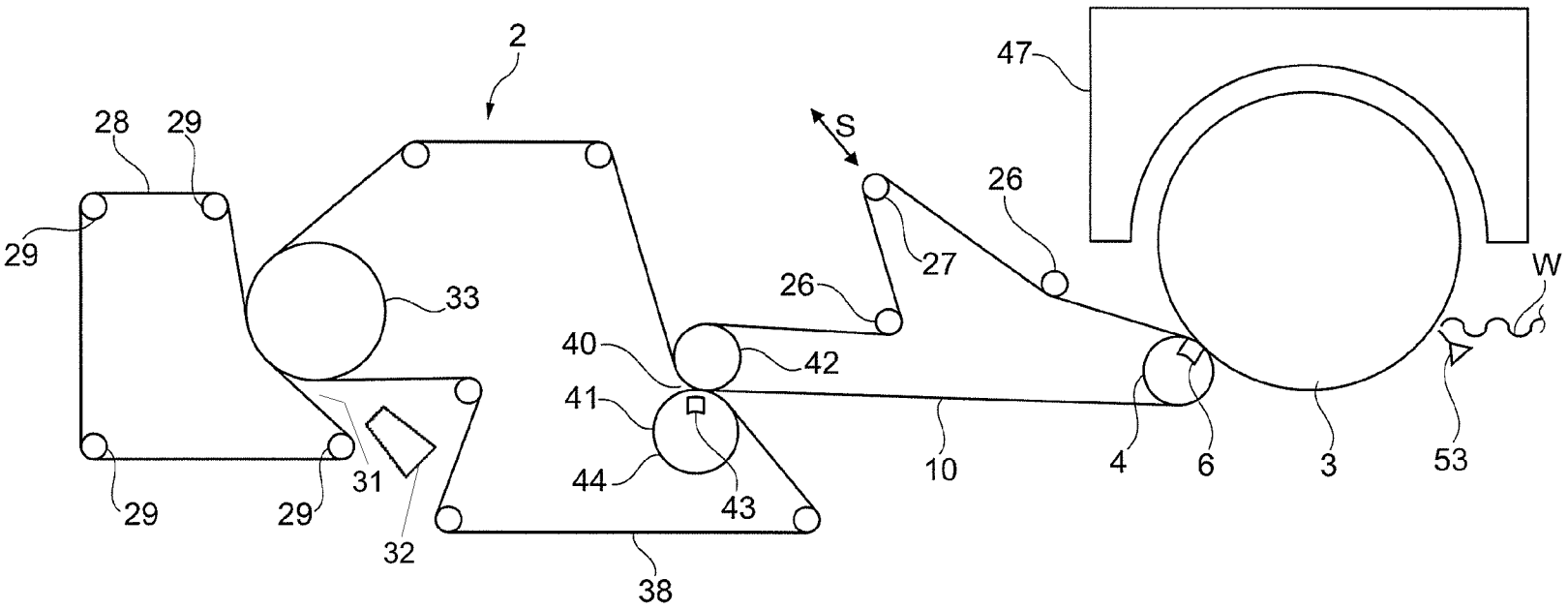
FIG. 11 is a schematic side view of a paper making machine according to a second embodiment of the present invention.

An alternative embodiment of the inventive paper making machine 1 will now be explained with reference to FIG. 11. In the embodiment of FIG. 11, the forming section 2 comprises a first forming fabric 28 arranged to run in a loop supported by guide elements 29 and a second forming fabric 38 arranged to run in a loop supported by guide elements 39. Unlike the carrier fabric 10 in the embodiment of FIG. 2, the second forming fabric 38 is not used to carry the fibrous web W to the Yankee drying cylinder. The second forming fabric 38 is water-receiving felt and arranged so in relation to the first forming fabric 28 that the two forming fabrics 28, 38 converge towards each other to form an inlet gap 31 into which stock can be injected. Just as in the embodiment of FIG. 2, a head box 32 is arranged to inject stock into the inlet gap 31 and a forming roll 33 arranged is within the loop of the second forming fabric. The forming roll may possibly be a forming roll such as the forming roll described with reference to FIGS. 4-9 but may also take other forms. For example, the forming roll 33 in the embodiment of FIG. 11 may be a suction roll or any other roll suitable as a forming roll.

In the embodiment of FIG. 11, the paper making machine 1 includes a pre-press 40. The pre-press 40 comprises an extended nip roll 41 and a counter roll 42 that forms a dewatering nip DN with the extended nip roll 41. The extended nip roll 41 comprises a pressure shoe 43 and a flexible jacket 44 that loops the pressure shoe 43. The extended nip roll 41 may any kind of known extended nip roll. For example, it could have a design as disclosed in EP 2808442 B1, EP 2085513 B1, U.S. Pat. Nos. 5,223,100, 5,084,137, 5,662,777 or 7,527,708 but the skilled person is aware of many other suitable designs. The pressure shoe may optionally be designed such that it has a surface facing the counter roll 42 which shoe surface is concave such that it matches the convex curvature of the counter roll 42 when the thickness of the fibrous web W, the flexible jacket 44 and any fabrics passing through the pre-press 40 is taken into account. The second forming fabric 38 is arranged carry the fibrous web W to the dewatering nip DN that is formed between the extended nip roll 41 and the counter roll 42 and to pass through the dewatering nip DN together with the fibrous web W. In the embodiment of FIG. 11, a carrier fabric 10 is arranged to pass through the dewatering nip DN and to carry the fibrous web W from the dewatering nip DN to the nip N formed between the shoe roll 4 and the Yankee drying cylinder 3 such that the fibrous web W is transferred to the surface of the Yankee drying cylinder 3. In the embodiment of FIG. 11, the carrier fabric 10 is a fabric that does not absorb water such that the nip between the shoe roll 4 and the Yankee drying cylinder 3 is a non-dewatering nip.

The pressure in the pre-press 40 is preferably set to a low level that does not entail any significant risk that the fibrous web W will be crushed. This means that dewatering in the pre-press 40 will not be so large but the dryness of the fibrous web W may still be increased to an acceptable level.

In the embodiment of FIG. 11, the carrier fabric 10 may be a water permeable structured fabric capable of imparting a three-dimensional structure onto the fibrous web W as the carrier fabric 10 passes through a nip. This means that a three-dimensional structure may be imparted into the fibrous web W as the fibrous web W passes through the pre-press 40 and the nip N against the Yankee drying cylinder 3. Such a fabric may be designed as a weave with warp, machine direction (MD) yarns and weft, cross direction (CD) yarns. An example of such a fabric is disclosed in, for example, U.S. Pat. No. 8,840,857 that discloses a structured fabric 28 that could conceivably be used in the present invention.

Alternatively, the carrier fabric 10 in the embodiment of FIG. 11 may be a water impermeable belt which has a structured surface 45 arranged to face the fibrous web W such that a three-dimensional structure can be imparted onto the fibrous web W as the carrier fabric 10 passes through a nip. The structured surface 45 is a surface provided with elevated areas and lowered or sunk areas. For example, the surface 45 may be a surface with elevated areas separated from each other by depressions or areas with depressions separated from each other by elevated areas. In this way, when the structured surface 45 is pressed against the fibrous web, the fibrous web W is given a three-dimensional structure that mirrors the pattern of elevations and depressions in the structured surface 45 of the carrier fabric 10. If the carrier fabric 10 is an impermeable belt with a structured surface, the structured surface may be according to, for example, U.S. Pat. No. 8,366,878 or 5,972,813 but the skilled person is aware of other possible designs of such a belt that can also be used.

Figure 12:
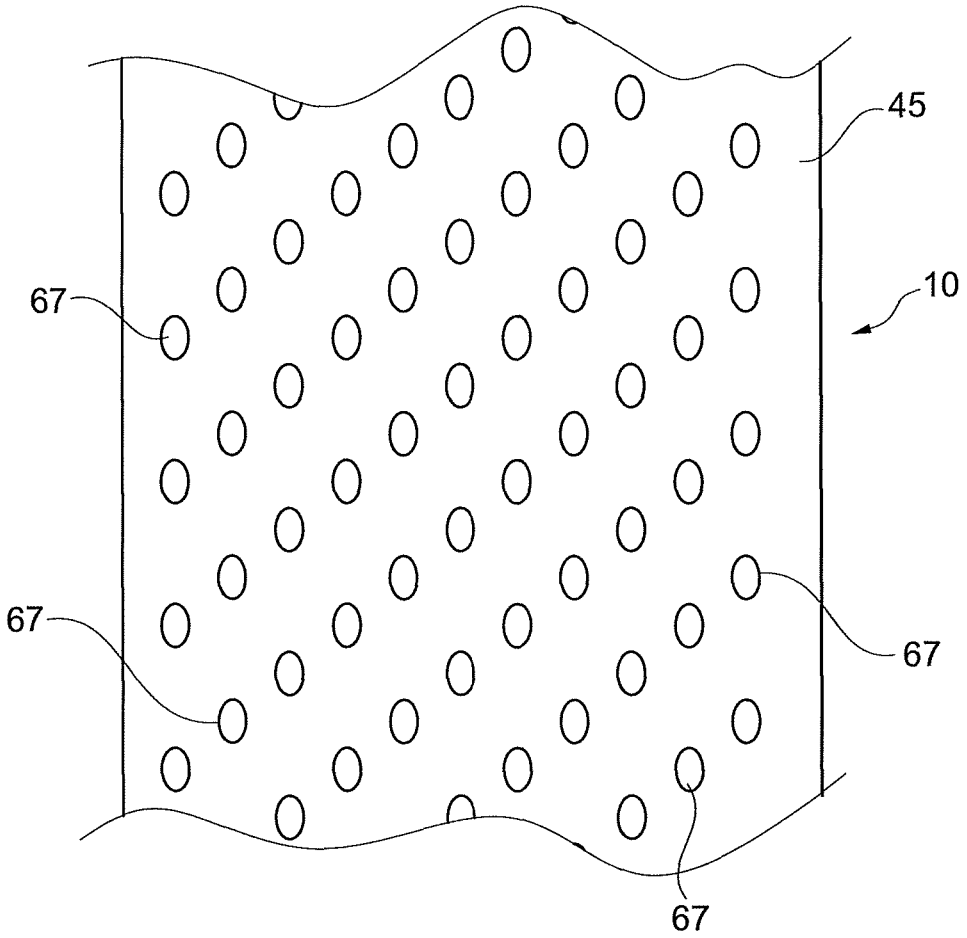
FIG. 12 is a view from above that schematically represents the surface of a carrier fabric that may be used in one embodiment of the invention.

FIG. 12 shows, from above, a structured/textured surface 45 of a carrier fabric 10 which may be an impermeable belt. The surface 45 will be facing the fibrous web W in the dewatering nip DN of the pre-press 40. As can be seen in FIG. 12, the surface 45 may have depressions 67 surrounded by elevated areas.

In yet another alternative embodiment, the carrier fabric 10 in the embodiment of FIG. 11 may be a water impermeable belt which has a smooth surface 46 that is arranged to face the fibrous web W. The surface 46 is smooth, i.e. it is even and substantially without elevations or depressions. When this smooth surface 46 is pressed against the fibrous web W, it will tend to simply make the surface of the fibrous web W more even rather than imparting upon it a three-dimensional structure. The use of a fabric with a substantially smooth (even) surface that contacts the fibrous web W entails the advantage that the fibrous web will more easily be transferred to the carrier fabric 10 since the fibrous web W tends to follow a smooth surface.

The carrier fabric in the embodiment of FIG. 11 may also be designed according to any of the embodiments of a paper-making belt disclosed in U.S. Pat. No. 7,914,649.

In the embodiments of FIG. 11, the tension in the carrier fabric 10 should also be kept in the range of 3.0 kN/m-5.0 kN/m and a stretcher roll 27 is arranged to achieve this function, just as in the embodiment of FIG. 2.

The invention may also be understood in terms of a method in which the inventive paper making machine is operated to produce tissue paper. In operation, the machine speed is suitably selected such that the carrier fabric 10 is running at a speed in the range of 1500 m/s-2300 m/s. During operation, the tension in the carrier fabric may be monitored and controlled such that the tension in the carrier fabric remain within the range of 3.0 kN/m-5.0 kN/m.

During operation, the method preferably comprises feeding pressurized air to the enclosed space 19 of the shoe rill 4 such that the enclosed space 19 is kept at an overpressure in the range of 60 millibar-100 millibar.

Thanks to the invention, a good transfer to the smooth surface 48 of the Yankee drying cylinder 3 can be achieved since the carrier fabric 10 has a sufficient tension which is possible due to the mechanical support 12 without the use of which the flexible tubular belt 9 would not be able to retain its shape. An added advantage is that, since the carrier fabric can wrap a large angle of the shoe roll 4, it is not necessary to guide the carrier fabric 10 and the fibrous web W over a turning roll (such as a suction turning roll) before the shoe roll 4 in order to guide the carrier fabric to the nep against the Yankee drying cylinder 3. This is of importance where available space is limited.

If other dewatering steps are taken before the fibrous web W reaches the Yankee drying cylinder, for example if more effective dewatering is achieved in the forming section 2, it is possible to avoid using a suction roll before the nipa against the Yankee drying cylinder.

While the invention has been described above in terms of a paper making machine and a method, it should be understood that these categories only reflect different aspects of one and the same invention. The method may thus comprise such steps that would inevitably follow from using various embodiments of the inventive machine, regardless of whether such steps have been mentioned explicitly or not. In the same way, the inventive machine may comprise means for performing any step of the method, regardless of whether such steps have been mentioned explicitly or not.

The invention claimed is:

1. A tissue paper making machine (1) comprising:

a forming section (2);

a Yankee drying cylinder (3);

a shoe roll (4) arranged to form a nip with the Yankee drying cylinder (3), the shoe roll (4) comprising:

a shoe (6) arranged to act against the Yankee drying cylinder (3) in the nip formed between the shoe roll (4) and the Yankee drying cylinder (3), the nip having a maximum extension from an entry point (7) of the nip to an exit point (8) of the nip; and a flexible tubular belt (9) that forms a loop around the shoe (6) and forms an outer circumference of the shoe roll (4);

a carrier fabric (10) arranged to be capable of carrying a fibrous web (W) from the forming section (2) to the nip formed between the Yankee drying cylinder (3) and the shoe roll (4) and pass through the nip between the Yankee drying cylinder (3) and the shoe roll (4)

together with the fibrous web (W), the carrier fabric (10) being arranged to reach the outer circumference of the shoe roll (4) at a first contact point (11) such that the carrier fabric (10) will wrap a part of the outer circumference of the shoe roll (4) over an area stretching from the first contact point (11) to the nip, wherein:

the shoe roll (4) further comprises a mechanical support (12) located inside the loop of the flexible tubular belt (9), the mechanical support (12) being placed to support the flexible tubular belt (9) in at least a part of the area between the first contact point (11) and the nip between the Yankee drying cylinder (3) and the shoe roll, the flexible tubular belt (9) has axial ends (15, 16) connected to end walls (17, 18) such that the end walls (17, 18) and the flexible tubular belt (9) define an enclosed space (19), and the paper making machine (1) further comprises a source (20) of pressurized air that can communicate with the enclosed space such that the enclosed space (19) can be filled with pressurized air, the carrier fabric (10) is under a tension which is in the range of 3.0 kN/m-5.0 kN/m, the carrier fabric (10) wraps the outer circumference of the shoe roll (4) in the area stretching from the first contact point (11) by an angle which is greater than 80°, the mechanical support (12) is arranged to support the flexible tubular belt (9) in the area from the first contact point to the nip over an angle that is more than 90° and the mechanical support (12) has an end positioned at a point (13) which, in a circumferential direction of the shoe roll (4) in a rotation direction of the carrier fabric (10), is closer to the entry point (7) of the nip than to the exit point (8) of the nip and which, for the maximum extension of the nip, is at an angular distance from the entry point (7) of the nip which is at least 8°.

2. A tissue paper making machine (1) according to claim 1, wherein the carrier fabric (10) wraps the outer circumference of the shoe roll in an area stretching from the first contact point by an angle which is in the range of 100°-280°.

3. A tissue paper making machine (1) according to claim 2, wherein the angle is in the range of 100°-200°.

4. A tissue paper making machine (1) according to claim 2, wherein the angle is in the range of 120°-180°.

5. A tissue paper making machine (1) according to claim 1, wherein the shoe (6) is deformable such that the shape of a surface of the shoe that faces the Yankee drying cylinder in the nip between the Yankee drying cylinder and the shoe roll can adapt to match the outer surface of the Yankee drying cylinder.

6. A tissue paper making machine (1) according to claim 1, wherein at least one applicator (21) for lubricant is located inside the flexible tubular belt (9) and arranged to be capable of applying a lubricant to an interior surface (22) of the flexible tubular belt (9).

7. A tissue paper making machine (1) according to claim 1, wherein a trough (24) is placed adjacent the shoe (6) in an area which, in the circumferential direction of the shoe roll (4), lies between the entry point of the nip (7) and the mechanical support (12) such that lubricant fluid that enters the nip and is pressed backwards out of the nip can be collected in the trough (24).

8. A tissue paper making machine (1) according to claim 1, wherein:

the forming section (2) comprises a first forming fabric (28) that is arranged to run in a loop supported by guide elements (29) and the carrier fabric (10) is a water-receiving felt which is used in the forming section (2) as a second forming fabric that is arranged to run in a loop supported by guide elements (26) and to carry the fibrous web (W) from the forming section (2) to the nip formed between the shoe roll (4) and the Yankee drying cylinder (3), the first forming fabric (28) and the carrier fabric (10) being so arranged in relation to each other that the two fabrics (10, 28) converge towards each other to form an inlet gap (31) into which stock can be injected, the forming section (2) further comprising a head box (32) arranged to inject stock into the inlet gap (31) and a forming roll (33) arranged within the loop of the carrier fabric (10), the forming roll (33) being arranged to guide the carrier fabric (10) into the inlet gap (31) and to guide the carrier fabric (10) and the first forming fabric (28) along a part of their path which is common to both the carrier fabric (10) and the first forming fabric (28) and which begins at the inlet gap (31), the forming roll (33) comprising a flexible sleeve (35) which is arranged to run in a loop around an axis of rotation (A) that extends in a direction perpendicular to the direction in which the carrier fabric (10) and the first forming fabric (28) are arranged to run; and the forming roll (33) further comprises a support ledge (36) located inside the loop of the flexible sleeve (35) and extending in a direction parallel to the axis of rotation of the flexible sleeve (35) and which support ledge (36) is arranged to be capable of pressing the flexible sleeve (35) in a direction outwards away from the axis of rotation of the flexible sleeve (35) in an area along the loop in which the flexible sleeve (35) is arranged to run such that, in the area in which the flexible sleeve (35) is pressed outwards by the support ledge (36), the flexible sleeve (35) is caused to follow a path with a radius of curvature which is smaller than the radius of curvature of the flexible sleeve (35) outside the area in which the support ledge (36) contacts the flexible sleeve (35).

9. A tissue paper making machine (1) according to claim 8, wherein the radius of the forming roll (33) in areas not in contact with the support ledge (36) is in the range of 500 mm-1600 mm and the smallest radius of the support ledge (36) is in the range of 40 mm-100 mm.

10. A tissue paper making machine (1) according to claim 9, wherein the smallest radius of the support ledge (36) is in the range of 45-80 mm.

11. A tissue paper making machine (1) according to claim 9, wherein the smallest radius of the support ledge (36) is in the range of 50 mm-75 mm.

12. A tissue paper making machine (1) according to claim 1, wherein:

the forming section (2) comprises:

a first forming fabric (28) arranged to run in a loop supported by guide elements (29);

a second forming fabric (38) arranged to run in a loop supported by guide elements (39), the second forming fabric (38) being a water-receiving felt and arranged so in relation to the first forming fabric (28) that the two forming fabrics (28, 38) converge towards each other to form an inlet gap (31) into which stock can be injected;

a head box (32) arranged to inject stock into the inlet gap (31);

a forming roll (33) arranged within the loop of the second forming fabric, a pre-press (40) comprising an extended nip roll (41) and a counter roll (42) that forms a dewatering nip with the extended nip roll (41), the extended nip roll (41) comprising a pressure shoe (43) and a flexible jacket (44) that loops the pressure shoe (43); and the second forming fabric (38) is arranged carry the fibrous web (W) to the dewatering nip that is formed between the extended nip roll (41) and the counter roll (42) and to pass through the dewatering nip together with the fibrous web (W), the carrier fabric (10) being arranged to pass through the dewatering nip and to carry the fibrous web (W) from the dewatering nip to the nip formed between the shoe roll (4) and the Yankee drying cylinder (3) such that the fibrous web (W) is transferred to the surface of the Yankee drying cylinder (3), the carrier fabric (10) being a fabric that does not absorb water such that the nip between the shoe roll (4) and the Yankee drying cylinder (3) is a non-dewatering nip.

13. A tissue paper making machine (1) according to claim 12, wherein the carrier fabric (10) is a water permeable structured fabric capable of imparting a three-dimensional structure onto the fibrous web (W) as the carrier fabric (10) passes through a nip.

14. A tissue paper making machine (1) according to claim 12, wherein the carrier fabric (10) is a water impermeable belt which has a structured surface (45) arranged to face the fibrous web (W) such that a three-dimensional structure can be imparted onto the fibrous web (W) as the carrier fabric (10) passes through a nip.

15. A tissue paper making machine (1) according to claim 12, wherein the carrier fabric (10) is a water impermeable belt which has a smooth surface (46) that is arranged to face the fibrous web (W).

16. A tissue paper making machine according to claim 1, wherein the mechanical support (12) comprises a guide shoe that is curved to correspond to the radius of curvature of the flexible tubular belt such that the flexible tubular belt (9) can glide on the mechanical support (12).

17. A method of operating a tissue paper making machine (1) according to claim 1, wherein the carrier fabric (10) is running at a speed in the range of 1500 m/s-2300 m/s and wherein the tension in the carrier fabric (10) is monitored and controlled such that it remains in the range of 3.0 kN/m-5.0 kN/m.

18. A method according to claim 17, wherein the method comprises feeding pressurized air to the enclosed space (19) such that the enclosed space (19) is kept at an overpressure in the range of 60 millibar-100 millibar.

19. A tissue paper making machine (1) according to claim 1, wherein the angular distance from the entry point (7) of the nip is 10°-20°.

* * * * *